US008944281B2

(12) United States Patent
Inoue et al.

(10) Patent No.: US 8,944,281 B2
(45) Date of Patent: Feb. 3, 2015

(54) UPRIGHT VIAL DISCHARGE UNIT

(75) Inventors: Mitsuhiro Inoue, Osaka (JP); Kazunori Tsukamoto, Osaka (JP); Yoshinori Maeji, Osaka (JP)

(73) Assignee: Yuyama Mfg. Co., Ltd., Toyonaka-shi (JP)

( * ) Notice: Subject to any disclaimer, the term of this patent is extended or adjusted under 35 U.S.C. 154(b) by 311 days.

(21) Appl. No.: 13/138,757

(22) PCT Filed: Mar. 25, 2010

(86) PCT No.: PCT/JP2010/055200

§ 371 (c)(1),
(2), (4) Date: Nov. 8, 2011

(87) PCT Pub. No.: WO2010/110360

PCT Pub. Date: Sep. 30, 2010

(65) Prior Publication Data

US 2012/0042609 A1 Feb. 23, 2012

(30) Foreign Application Priority Data

Mar. 26, 2009 (JP) ..... 2009-077622
Jul. 24, 2009 (JP) ..... 2009-172825

(51) Int. Cl.

| | |
|---|---|
| ***A61J 3/00*** | (2006.01) |
| ***B65B 43/42*** | (2006.01) |
| ***G07F 11/16*** | (2006.01) |
| ***G07F 11/70*** | (2006.01) |
| ***G07F 17/00*** | (2006.01) |
| *B65B 5/10* | (2006.01) |

(52) U.S. Cl.

CPC ..... *B65B 43/42* (2013.01); *G07F 11/165* (2013.01); *G07F 11/70* (2013.01); *G07F 17/0092* (2013.01); *B65B 5/103* (2013.01)

USPC ..... 221/172; 221/254; 221/89; 221/90

(58) Field of Classification Search

USPC ..... 221/193, 191, 156, 171, 172, 254, 89, 221/90; 141/174, 369, 370, 375

See application file for complete search history.

(56) References Cited

U.S. PATENT DOCUMENTS

| | | | | | |
|---|---|---|---|---|---|
| 2,863,552 | A | * | 12/1958 | Bailey | 198/409 |
| 2,994,420 | A | * | 8/1961 | Tobias | 193/32 |
| 3,017,011 | A | * | 1/1962 | Meyer | 198/400 |
| 3,106,281 | A | * | 10/1963 | Mottin | 198/399 |
| 4,201,313 | A | * | 5/1980 | Kirsch | 221/171 |
| 4,871,086 | A | * | 10/1989 | Davies et al. | 221/4 |

(Continued)

FOREIGN PATENT DOCUMENTS

| | | | |
|---|---|---|---|
| JP | 2009-291 | | 1/2009 |
| WO | WO 2008156111 | A1 * | 12/2008 |

*Primary Examiner* — Patrick Mackey
(74) *Attorney, Agent, or Firm* — Masuvalley & Partners

(57) ABSTRACT

The medicine packing machine is equipped with a loading unit that is capable of receiving and delivering vials retrieved from a stocker, and a supplying unit that is capable of delivering the vials from the loading unit in an upright position. A control unit is also disposed between the loading unit and the supplying unit. As a result of the presence of the control unit, the transfer of vials received by the loading unit is controlled by the control unit in such a manner that the vials are not ejected towards the supplying unit. The vials are also controlled so as to be in an upright position once loaded into the loading unit. As a result of these actions, the vials received by the loading unit are reliably delivered to the supplying unit without being ejected or jamming at unanticipated locations.

20 Claims, 21 Drawing Sheets

(56) References Cited

U.S. PATENT DOCUMENTS

| | | | | |
|---|---|---|---|---|
| 5,318,200 | A * | 6/1994 | Allen et al. | 221/192 |
| 5,439,093 | A * | 8/1995 | Drewitz | 198/399 |
| 5,860,563 | A * | 1/1999 | Guerra et al. | 221/172 |
| 6,227,407 | B1 * | 5/2001 | Simeri et al. | 221/254 |
| 6,478,185 | B2 * | 11/2002 | Kodama et al. | 221/6 |
| 7,100,796 | B1 * | 9/2006 | Orr et al. | 221/191 |
| 7,222,719 | B2 * | 5/2007 | Shackelford et al. | 198/459.2 |
| 8,047,352 | B2 * | 11/2011 | Yuyama | 198/413 |
| 8,146,777 | B2 * | 4/2012 | Inamura | 221/65 |
| 8,403,010 | B2 * | 3/2013 | Taniguchi et al. | 141/171 |
| 8,651,320 | B2 * | 2/2014 | DuMond et al. | 221/6 |

* cited by examiner (a)

(b)

(a)

(b)

UPRIGHT VIAL DISCHARGE UNIT

This application is a national phase application under 35 U.S.C. §371 of International Application Serial No. PCT/JP2010/055200 filed on Mar. 25, 2010. This application claims priority under 35 U.S.C. §119 to Japan patent applications JP2009-077622 filed on Mar. 26, 2009 and JP2009-172825 filed on Jul. 24, 2009. All these applications are incorporated herein by reference.

TECHNICAL FIELD

The present invention relates to a medicament filling machine for filling medicine in a vial, and particularly relates to structural features of the sections until an empty vial container prepared for the filling of the medicine is supplied in upright posture.

BACKGROUND OF THE INVENTION

Conventionally, similar to a tablet filling device disclosed in Patent Document 1 below, a device is provided in which a vial is moved from a stocker to a predetermined position, and the medicine is filled into this. In such type of a device, while being transported to the location for filling the medicine, the vial fetched from the stocker needs to be made into an upright position with an opening orienting in the upper direction. Therefore, to solve such a problem, for example a vial supply device such as that disclosed in the Patent Document 2 below, has been used in tablet filling devices.

The bottle supply device disclosed in Patent Document 2 consists of a receptor to receive a vial falling down vertically, and an inclined part and a flap provided at its bottom, and also a platform provided below them. In this supply device, when a vial is loaded in the receptor, the vial is fed in upright position from the opening provided at the bottom of the receptor, and moves along the inclined part to the platform. During this, since a flap provided with a spindle touches the vial, the vial slowly reaches the platform while maintaining the upright position.

PRIOR ART LITERATURE

Patent Literature

Patent document 1: Japanese Patent Application Publication 2009-000291

Patent document 2: U.S. Pat. No. 71,100,796

SUMMARY OF THE INVENTION

Problem to be Solved by the Invention

In the tablet filling device disclosed in the Patent Document 1, the vial retrieved from the stocker is dispatched by falling through a chute, and the vial was made upright during this process. In such a configuration, the vial was usually dispatched smoothly without getting stuck in any place. However, based on extensive investigations to find out whether there were other strategies to feed (dispatch) the vial retrieved from the stocker more smoothly and reliably, it was found effective to temporarily steady the posture of the vial container until the vial retrieved from the stocker is dispatched in upright position.

Based on such finding, the present invention is intended to provide a medicament filling machine in which empty vials, prior to filling medicine, can be dispatched more smoothly and reliably than the medicament filling machine of the prior art.

Means to Solve the Problem

To solve the problem described above, the medicament filling machine of the present invention is provided with a bottle storage unit that can randomly store empty vials, a dispatch mechanism unit that can accept the empty vial stored in the bottle storage unit and forward it, an upright-dispatch unit that can accept the vial dispatched from the dispatch mechanism unit and discharge it in an upright posture, and a regulation means disposed between the dispatch mechanism unit and the upright-discharge unit. In the medicament filling machine of the present invention, the regulation means controls the movement of the vial from the dispatch mechanism unit to the upright-discharge unit and/or controls a posture of the vial received in the dispatch mechanism unit.

Another aspect of the medicament filling machine of the present invention is provided with a dispatch mechanism unit that accepts an empty vial and forwards it, an upright-discharge unit that accepts the vial dispatched from the dispatch mechanism unit and discharges it in an upright posture, and a regulation means disposed between the dispatch mechanism unit and the upright-discharge unit. When the dispatch mechanism unit is in a state of accepting the vial, the movement of the vial from the dispatch mechanism unit to the upright-discharge unit is controlled by the regulation means, and when the dispatch mechanism unit is in a state of dispatching the vial, the movement control by the regulation means is released.

In the medicament filling machine of the present invention, the regulation means may be configured by a plate supported by a pivot to freely rotate around the pivot. In this configuration, in the medicament filling machine of the present invention, it is preferable that when the dispatch mechanism unit is in the state of receiving the vial, the regulation means is supported so as to divide the space between the dispatch mechanism unit and the upright-discharge unit, and when the dispatch mechanism unit dispatches the vial, the regulation means is pressed and rotated by the dispatch mechanism unit and/or the vial received by the dispatch mechanism unit and becomes a state to facilitate a passage of the vial from the dispatch mechanism unit to the upright-discharge unit. Further, the dispatch mechanism unit may forward the vial by tumbling in the direction of the upright-discharge unit. Moreover, in the medicament filling machine of the present invention, it is preferable to provide a stopper in the downstream location of the regulation means regarding the direction of the vial movement from the dispatch mechanism unit to the upright-discharge unit to regulate the movement of the vial in the downward direction.

In the medicament filling machine of the present invention, a sliding unit may be provided in the downstream location of the regulation means in respect to a direction of the vial movement from the dispatch mechanism unit to upright-discharge unit, and the vial dispatched from the dispatch mechanism unit may slide on the sliding unit. Also, in the medicament filling machine of the present invention, a pair of sliding surfaces may be provided on the sliding unit, and the vial may slide on the pair of sliding surfaces. The pair of sliding surfaces may be inclined downward in the downstream direction of the vial movement from the dispatch mechanism unit to the upright-discharge unit. Moreover, in the medicament filling machine of the present invention, a pair of sliding surfaces may be provided on the sliding unit, and the vial can slide on the pair of sliding surfaces. The gap between the pair of sliding surfaces may gradually increase in the downstream direction of the vial movement from the dispatch mechanism unit to the upright-discharge unit. In other words, in the medicament filling machine of the present invention, the gap between the pair of sliding surfaces may spread out in the downstream direction. In the medicament filling machine of the present invention, the gap between the pair of sliding surfaces may gradually decrease in the downward direction. In other words, in the medicament filling machine of the present invention, the gap between the pair of sliding surfaces may also taper in the downward direction. Here, the phrase 'gap gradually increases' in the present invention refers to the gap gradually increasing, and the phrase 'gap tapers' refers to the gap gradually decreasing.

In the medicament filling machine of the present invention, a pair of sliding surfaces may be provided on the sliding unit, and the vial can slide on the pair of sliding sides. In at least a part of the sliding surface, a downward slope section that functions as a downward slope may be provided. The downward slope may slope downward in the downstream direction of the vial movement. Although this downward slope section can be formed from a flat surface, it can also be formed of a curved surface curved in a downward direction. In the medicament filling machine of the present invention, if the slide section is provided with a side below the slide surface and continuous to the slide surface, it is preferable to configure the ridge section forming the boundary between the downward slope and the side surface provided in the sliding unit to have a curved shape or a chamfered shape.

In the medicament filling machine of the present invention, it is preferable to provide a bottle-restraining means for restraining the vial dispatched from the dispatch mechanism unit to the upright-discharge unit from returning to the dispatch mechanism unit from the upright-discharge unit. In the medicament filling machine of the present invention, a chair-like member, or a seat surface, on which the vial sits, may be provided in the dispatch mechanism unit. If the dispatch mechanism unit dispatches the vial from the dispatch mechanism unit to the upright-discharge unit by rotating the seat surface in the direction of the upright-discharge unit, it is preferable to provide the bottle-restraining means on an extended location of the sliding section that is below the seat surface.

In the medicament filling machine of the present invention, the upright-discharge unit may also be provided with a pair of passage structures facing to each other, and between this pair of passage structures may be provided a pathway of the vial. The sliding unit may be provided with a pair of sliding members, and each slide member may be installed on each passage structure. In the medicament filling machine of the present invention, either or both of the sliding members may be provided with a sliding surface, and the vial may slide on the sliding surface. In this configuration, it is preferable that the sliding surface is inclined towards the inside of the vial pathway. Further, it is preferable that the sliding surface is inclined in the downward direction as it goes in the downstream direction of the vial movement from the dispatch mechanism unit to the upright-discharge unit.

In the medicament filling machine of the present invention, the sliding section is preferably provided between the stopper and the regulation means.

In the medicament filling machine of the present invention, a labeling means for pasting a label on the vial can be provided in a location of the downstream side of the vial movement direction and can be separated from the discharge position of the vial in the upright-discharge unit. The labeling means may be provided with an outer periphery abutting means that can come in contact with the outer periphery of the vial. It is possible to set the outer periphery abutting means in a state that prevents the vial from popping out by moving the outer periphery abutting means to a vicinity of the discharge position. In this configuration, it is preferable to set the outer periphery abutting means in the state wherein the pop-out of the vial is prevented during at least a part of the period while the vial is dispatched from the dispatch mechanism unit to the upright-discharge unit and delivered in an upright position from the upright-discharge unit.

In the medicament filling machine of the present invention, the bottle storage unit can be provided with a stocker in which bottles can be stored randomly, and a conveyor arranged in the bottom portion of the stocker that can transfer the vial. It is possible to configure the bottle storage unit to deliver the vial, transported by the conveyor, out of the stocker. When such a bottle storage unit is provided, it is preferable to provide a bottle-sliding wall for facilitating the sliding of the vial in the upstream of the discharge direction of the vial and in a location adjacent to the conveyor. Moreover, it is preferable that the bottle-sliding wall is provided with an ascending slope section that has ascending slope in a direction away from the conveyor, and an upright section whose inclination is steeper than the ascending slope section and almost vertical. The upright section is preferably continuous to the ascending slope section.

In the medicament filling machine of the present invention, it is possible to provide a transfer means between the dispatch mechanism unit and the bottle storage unit for transporting the vial, which is fetched from the bottle storage unit, toward the dispatch mechanism unit. It is possible to provide a bottle detection means for detecting the existence of the vial at the discharge location where the vial is discharged in the transfer means. In such a configuration, it is also possible to determine that a failure of the vial discharge has occurred, following a condition in which the presence of the vial in the discharge location is detected by the bottle detection means after the detection of the presence of the vial by the bottle detection means and after moving the vial waiting at the discharge location by a distance sufficient to discharge the vial out of the transfer means by an operation of the transport means.

Further, when the bottle detection means is provided as described above, after checking the presence of the vial in the discharge location by the bottle detection means, after moving the vial by a sufficient distance for discharging the vial waiting at the discharge location by the transport means, and after detecting the existence of the vial by the bottle detection means at the discharge location, the transport means may move the vial in a direction opposite to the discharge location. And, a criterion may be added to determine if a defective discharge of the vial has occurred based on a condition in which the bottle detection means still detects the existence of the vial even after the transport means moves the vial in a direction opposite to the discharge location.

Effect of the Invention

In the medicament filling machine of the present invention, after retrieving the vial from the bottle storage unit where the empty vials are randomly stored, and receiving this vial temporarily in the dispatch mechanism unit, it is possible to dispatch the vial towards the upright-discharge unit. In the medicament filling machine of the present invention, the vials are stored randomly in the bottle storage unit. When the vial is received by the dispatch mechanism unit, the vial is empty. Due to this, when the vial is received by the dispatch mechanism unit, there is a high possibility that the posture of the vial is unstable. Considering these factors, a regulation means is provided between the dispatch mechanism unit and the upright-discharge unit in the medicament filling machine of the present invention. With this, in the medicament filling machine of the present invention, after temporarily steadying the vial received by the dispatch mechanism unit, it can be dispatched towards the upright-discharge unit. Therefore, in the medicament filling machine of the present invention, the vial can be delivered in a constant posture towards the upright-discharge unit, and stuck or jam of the vial in the upright-discharge unit is surely prevented.

Further, in the medicament filling machine of the present invention, when the regulation means controls the movement of the vial from the dispatch mechanism unit to the upright-discharge unit and/or controls the posture of the vial received in the dispatch mechanism unit, occurrence of defects such as the vial's popping out to an unexpected spot, or stuck or jam of the vial by being dispatched in an unexpected posture can be surely prevented.

In the medicament filling machine of the present invention, when the dispatch mechanism unit is in a standby state for receiving the vial (hereafter, referred as 'bottle-standby state'), a controlled state is created by the regulation means such that the vial does not move from the dispatch mechanism unit to the upright-discharge unit. Due to this, in the bottle-standby state, there are no defects in which the empty vial loaded in the dispatch mechanism unit bounds and pops out toward the upright-discharge unit or gets stuck in unexpected places. Further, in the medicament filling machine of the present invention, after the vial is readied in the dispatch mechanism unit as the bottle-standby state, when the dispatch mechanism unit begins dispatching the vial, the restriction of the movement of the vial by the regulation means is released (hereafter, referred as 'control-release state'), and the vial is delivered towards the upright-discharge unit. Accordingly, in the medicament filling machine of the present invention, after the posture of the vial is adjusted in the bottle-standby state, the vial is delivered towards the upright-discharge unit. Therefore, in the medicament filling machine of the present invention, the vial can be delivered in a desired posture towards the upright-discharge unit, and the vial getting stuck or jammed in the upright-discharge unit can be surely prevented.

In the medicament filling machine of the present invention, if a plate-like member supported so as to freely rotate is used as the regulation means, the vial can be controlled in the bottle-standby state so as not to move from the dispatch mechanism unit to the upright-discharge unit by partitioning the space between the dispatch mechanism unit and upright-discharge unit by the plate acting as the regulation means, and the posture of the vial received in the dispatch mechanism unit can be reorganized. By using the dispatching mechanism unit wherein it is possible to invert the vial and dispatch to the upright-discharge unit, and wherein at the time of dispatching the vial by the dispatch mechanism unit, the dispatch mechanism unit or the vial presses and rotates the plate-shaped regulation means so as to release the regulation state, it is possible to smoothly deliver the vial towards the upright-discharge unit.

If the regulation means as in the present invention is provided, even after the vial is dispatched from the dispatch mechanism unit to the upright-discharge unit after switching to the regulation release state, it is preferable to have a configuration to prevent a popping-out of the vial. Based on this finding, it is preferable to provide a stopper for the regulation means in a location on the downstream of the vial movement direction from the dispatch mechanism unit to the upright-discharge unit. By providing such a configuration, the movement of the vial dispatched towards the upright-discharge unit in the direction of the movement can be controlled by the stopper, and unexpected popping out of the vial can be prevented.

Here, in the regulation release condition, when the vial is dispatched from the dispatch mechanism unit to the upright-discharge unit, if the vial is made smoothly slide, drawbacks such as trapping of the vial in unexpected places or popping out can be prevented. As described above, in case of the configuration wherein the regulation means is changed into the regulation release condition by the movement of the dispatch mechanism unit or the vial received in it, since the regulation means works as a resistance against the movement of the vial, it is preferable to have a configuration wherein the vial can slide more smoothly. Thereupon, in the medicament filling machine of the present invention, a sliding unit is provided to the regulation means in the downstream of the movement direction of the vial from the dispatch mechanism unit to the upright-discharge unit, and enables the vial dispatched from the dispatch mechanism unit to slide on this sliding unit. Due to this, when the vial is dispatched from the dispatch mechanism unit to the upright-discharge unit, the vial can smoothly move, and drawbacks such as trapping or popping out of the vial dispatched from the dispatch mechanism unit hardly occurs.

Along with providing the slide section as described above, if a pair of sliding surfaces is provided in this slide section and sliding of the vial on this is facilitated, by providing the sliding surface so as to incline down towards the downstream of the direction of the vial movement from the dispatch mechanism unit to the upright-discharge unit, the vial smoothly slides along the inclination of the sliding surface, and drawbacks such as being trapped or jammed does not occur. When the pair of sliding surfaces is provided on the slide section, if the space between this pair of sliding surfaces is configured so as to gradually increase in the downstream of the direction of the movement of the vial from the dispatch mechanism unit to the upright-discharge unit, it is possible for the vial to slide more smoothly on the sliding surface, and drawbacks such as being trapped or blocked does not occur. Furthermore, if a pair of sliding surfaces is provided on the slide section, and if the gap between this pair of sliding surfaces is configured so as to gradually decline in the downward direction, the posture of the vial that slides along the sliding surface can be smoothly made into an upright state.

As described above, if a downward slope section, which is a down slope in the downstream direction of the bottle movement, is formed on the pair of sliding surfaces provided on the slide section, the posture of the vial changes to an upright direction posture under the influence of its own weight balance when the vial approaches the downward slope section. Due to this, by providing the downward slope section, the vial can be delivered from the upright-discharge unit more smoothly and surely in an upright posture. If the downward slope is configured by a curved surface that curves in the downward direction, the vial undergoes a posture change more smoothly, and is delivered.

In the medicament filling machine of the present invention, if there is provided a side surface that is continuous to the sliding surface and that is below the sliding surface, by forming the ridge at the boundary between this side surface and the downward slope provided on the sliding surface in a circular shape or chamfered shape, the vial can be delivered smoothly without being trapped in the ridge section.

In the medicament filling machine of the present invention, due to a configuration of dispatching the empty vial from the dispatch mechanism unit to the upright-discharge unit, the vial that has entered the upright-discharge unit may return to the dispatch mechanism unit because of a shock at the time of dispatch. During this, if the vial jumps out from the upright-discharge unit, there is a possibility to result in a supply failure of the vial, or jamming of the vial in an unexpected place. Thereupon, based on this finding, in the medicament filling machine of the present invention, by providing the bottle-restraining means, the vial, which is dispatched from the dispatch mechanism unit to the upright-discharge unit, is prevented from moving back to the dispatch mechanism unit, and getting dispatched from the upright-discharge unit to the dispatch mechanism unit. Thereby, the problem described above is solved.

Further, if a seat surface, on which the vial is loaded, is provided in the dispatch mechanism unit, and if the vial is discharged from the dispatch mechanism unit to the upright-delivery unit by rotating the seat surface in the direction of the upright-discharge unit, it is possible that phenomena of the vial bouncing back due to a shock at the time of dispatch, or returning to the dispatch mechanism unit by sliding along the slide section provided in the upright-delivery unit, may occur. Further, in case of a configuration wherein the seat surface rotates towards the upright-delivery unit, it is possible that a space may be formed under the seat surface due to the floating of the seat by the rotation at the time of dispatch of the vial, and the vial may enter this space. Focusing on this problem, in the present invention, a bottle-restraining means is provided at a location below the seat surface on the extended length of the slide section that is provided in the upright-discharge unit. Therefore, according to the present invention, the drawbacks of bouncing back of the vial from the upright-discharge unit side to the dispatch mechanism unit, or mistakenly popping out of the vial sliding along the slide section from the dispatch mechanism unit, or entering in the space below the seat can be reliably prevented.

In the medicament filling machine of the present invention, with regard to the pair of passage structures that constitute the upright-delivery unit, if the slide section is configured by installing a pair of slide members, it becomes possible to retrofit the slide section to the already existing upright-discharge unit. Further, by providing a sliding surface on either or both of the pair of slide members, and inclining towards the inside of the vial pathway, the gap of the vial pathway is tapered in the downward direction, and the posture of the vial can be smoothly made into an upright posture along the sliding surface. In addition, if the sliding surface formed in the slide member is made into a downward slope in the downstream direction of the vial movement from the dispatch mechanism unit to the upright-delivery unit, the vial discharged from the dispatch mechanism unit smoothly slides along the inclination of the sliding surface, and there is no problem of trapping or blocking.

By providing the slide section between the stopper and regulation means, the vial that is dispatched from the dispatch mechanism unit and comes sliding on the slide section can be reliably prevented from popping out into unexpected places.

As described above, if the labeling means for pasting a label on the vial is provided in a location in the downstream direction of the vial movement away from the discharge location of the vial in the upright-delivery unit, by making the outer periphery abutting means of this labeling means to move to the side of the discharge location (jump-prevention state), the vial discharged from the dispatch mechanism unit to the upright-delivery unit is prevented from popping out from the upright-delivery unit by this outer periphery abutting means. In addition, by putting the outer periphery abutting means in a jump-prevention state during part of the period or whole period of when the vial is dispatched from the dispatch mechanism unit to the upright-discharge unit and delivered in the upright position from the upright-discharge unit, unexpected popping out of the vial from the upright-delivery unit can be more reliably prevented.

Here, in the medicament filling machine of the present invention, the vials can be accommodated randomly in the stocker of the bottle storage unit, and the vial can be conveyed by the conveyor disposed at the bottom of the stocker, and fed to the dispatch mechanism unit. When such a configuration is adopted, if the conveyor is operated in a direction opposite to that of retrieving the vial from the stocker (reverse operation), it is possible to provide a state wherein the vials are accommodated approximately uniformly throughout inside of the stocker. On the contrary, since the vials accommodated in an empty state are open for filling medicine, if the reverse operation of the conveyor is performed, there is also a possibility that the empty vials that are stagnating by the wall located upstream of the vial discharge direction to the conveyor may crowd together and one vial may engage with an opening of another vial. When many vials become integrated, these vials cannot be used for filling medicine unless they are manually separated. If the vial aggregate due to the engagement of the multiple vials is retrieved from the stocker and conveyed to a subsequent process, they may become responsible for a failure such as clog in an unexpected location. Accordingly, it is preferable that some means should be worked out so that the vials do not mutually engage with each other even when the conveyor is operated in a reverse direction as explained above.

Thereupon, based on such finding, the medicament filling machine of the present invention, adopted a configuration wherein a bottle sliding wall for sliding the vial is provided in a location adjacent to the upstream of the discharge direction of the vial by this conveyor corresponding to the conveyor provided in the stocker. With such a configuration, when the conveyor is moved in the reverse direction, in the location abutting the conveyor, the vial smoothly slides along the bottle sliding wall without stagnating, and mutual engagement of the bottles is difficult to occur. Therefore, by providing the bottle sliding wall as described above, it is possible to prevent drawbacks such as non-usability of bottles for medicine filling due to mutual engagement of plural vials, or blocking by the integrated bottles due to conveying them to the next process.

When the bottle sliding wall as described above is provided, by adopting a configuration wherein an ascending slope having a slope rising as being away from the conveyor is provided, the vials smoothly moves in a location upstream of the conveyor without stagnating in the location abutting the discharge direction of the vials when the conveyor is operated in the reverse direction. Therefore, by providing the ascending slope as described above, it is possible to reliably prevent the integration of the vial due to the mutual engagement, or the failures accompanying this. Moreover, by adding the bottle sliding wall to the ascending slope section and consecutively providing a vertical section whose inclination is nearly-vertical, the vials is able to move more smoothly, and mutual engagement of the vials can be more reliably prevented.

If the integrated body formed by the mutual engagement of plural vials is fed to the dispatch mechanism unit or upright-delivery unit, various problems arise including the failure of the main device unit. Therefore, in the medicament filling machine of the present invention, when the integrated body formed by the mutual engagement of plural vials exists, it is preferable to provide a configuration that can detect the aggregation before it is fed to the dispatch mechanism unit or upright-delivery unit. Thereupon, based on this finding, in the present invention, a transfer means is provided between the dispatch mechanism unit and bottle storage unit, and while conveying the vial retrieved from the bottle storage unit by this towards the dispatch mechanism unit, a bottle detection means detects the vial at the discharge location of the transfer means, and based on the detection result, judgment of the existence of discharge failure of the vial is performed.

More specifically, when the presence of the vial at the discharge location of the transfer means is confirmed by the bottle detection means, and if the vials are scattered without mutual engagement, and if the vial that is waiting at the discharge location is discharged by further advancing the transfer means by an amount just enough to discharge the vial, it is thought that the vial becomes in a state where it is not detected by the bottle detection means. On the other hand, in case of plural vial reaching the discharge location in a mutually engaged state, even if the transfer means is operated by an amount sufficient to discharge the vial under normal circumstances, the vial is not be discharged to the dispatch mechanism unit, and is expected to remain at the discharge location of the transfer means. Therefore, in a state wherein the vial has been detected by the bottle detection means, when the presence of the vial is still detected by the bottle detection means even after operating the transfer means by an amount just sufficient to supply the vial to the dispatch mechanism unit, it is likely that plural vials are integrated by mutual engagement. Based on this finding, in the present invention, following detection of the vial by the bottle detection means, the transfer means is operated to move the vial by an amount just sufficient to discharge the vial. Even after this, if the vial is still detected, it is determined that the vial discharge failure has occurred. Therefore, according to the present invention, it is possible to accurately judge the possibility that several vials are integrated by the mutual engagement.

Although it is a rare case, there is a possibility that another bottle exists without engagement at the location abutting the downstream side of a vial that has arrived at the discharge location of the transfer means. In such case, when the vial at the discharge location is discharged by the operation of the transfer means, the vial on the upstream side arrives at a place where it can be detected by the bottle detection means. In this case, with only the above criterion, it leads to a misjudgment that a discharge failure is caused because of the vials being in an engaged state. Therefore, to prevent erroneous detection of vials that are present by queuing without a gap but without engagement, it is preferable to add another criterion. Based on this finding, in the present invention, in the state when the vial is waiting at the discharge location of the transfer means, if the vial is still detected by the bottle detection means after the transport means is operated by an amount just enough to discharge a vial, the vial is further moved by a predetermined amount in a direction opposite to the discharge direction of the vial by operating the transfer means. If the bottle detection means still detects the presence of the vial even after this (inclusion condition), it is determined that a discharge failure has occurred due to the engagement of vials.

This condition is explained in more detail. When many vials integrate by engaging, the integrated stuff is longer than the usual length of the vial. Due to this, in case of many vials integrating by engaging, in the state wherein the transfer means is operated just sufficient for dispatching a vial when the vial is present at the discharge position of the transfer means, it becomes a state wherein the vial is protrudes beyond the discharge position of the transfer means. Therefore, when the vials integrate by engaging, if the transfer means is operated to move the vial by a predetermined amount in a direction opposite to the direction of discharge of the vial, the portion protruding beyond the discharge position is pulled back, and subsequently the vial is detected by the bottle detection means.

On the other hand, in case the vials are substantially queuing up without a gap, when the transfer means is operated such that it is just sufficient to dispatch the vial, the vial that is in the downstream side is dispatched towards the dispatch mechanism unit. Due to this, when the vials are substantially queuing up in a non-engaged state, even if the transfer means is operated so as to move the vial by a predetermined amount in a direction opposite to the discharge direction of the vial, the vial that was in the downstream is not pulled back to the discharge position. Further, an upstream vial is pulled back in a further upstream side by operating the transfer means in the opposite direction, and it cannot be detected by the bottle detection means. Therefore, if a condition of detecting the vial by the bottle detection means is added after the transfer means moves the vial in the opposite direction as a condition for determining a discharge failure, it is possible to determine whether the vial is in an engaged state or not with far more reliability.

DETAILED DESCRIPTION OF THE INVENTION

Figure 1:
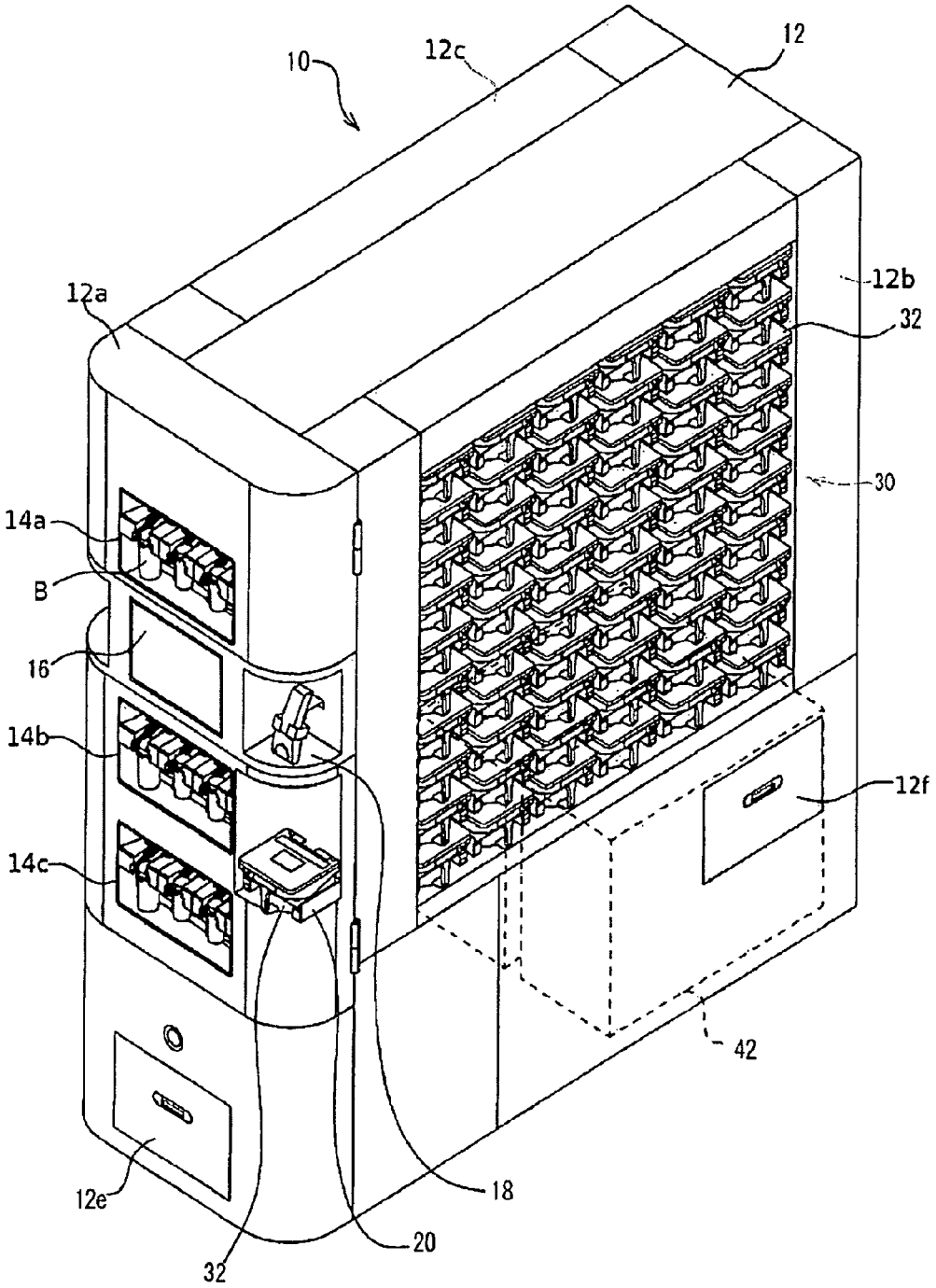
FIG. 1 is a perspective view showing a medicament filling machine of one embodiment of the present invention.
Figure 3:
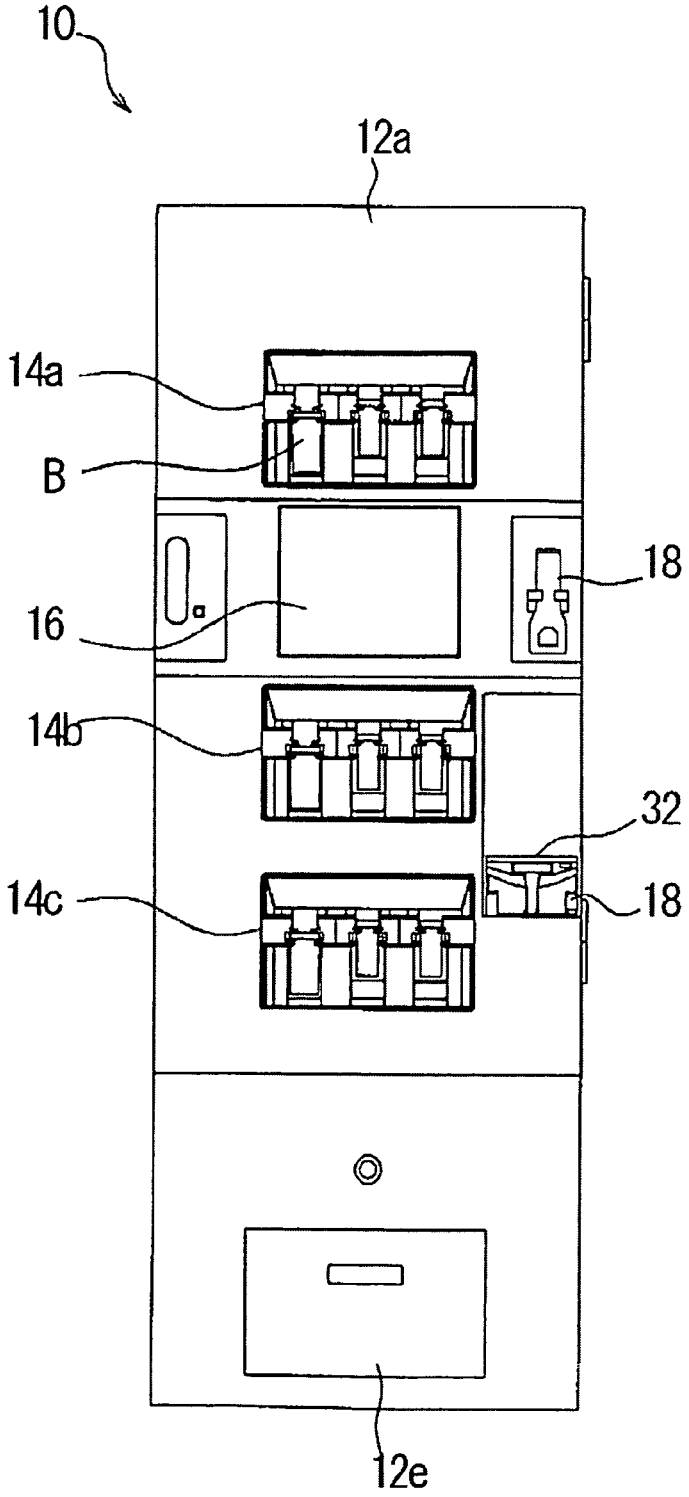
FIG. 3 is a front view of the medicament filling machine shown in FIG. 1.

In continuation, a medicament filling machine 10 provided in one embodiment of the present invention will be explained while referring to diagrams. The medicament filling machine 10 is a device for filling tablets (medicine) in a vial and supplying. As shown in FIG. 1 and FIG. 3, on the front side 12*a* of the device body 12 of the medicament filling machine 10 are provided retrieving windows 14*a*-14*c* for retrieving medicine-filled vial B, an operating panel 16, a bar code reader 18*a*, and a working bench 18*b*. Below the front side 12*a* is provided a drawer door 12*e*, and by pulling this door, a labeling unit 70 (see FIG. 6) installed in the device body 12 can be pulled out.

Figure 2:
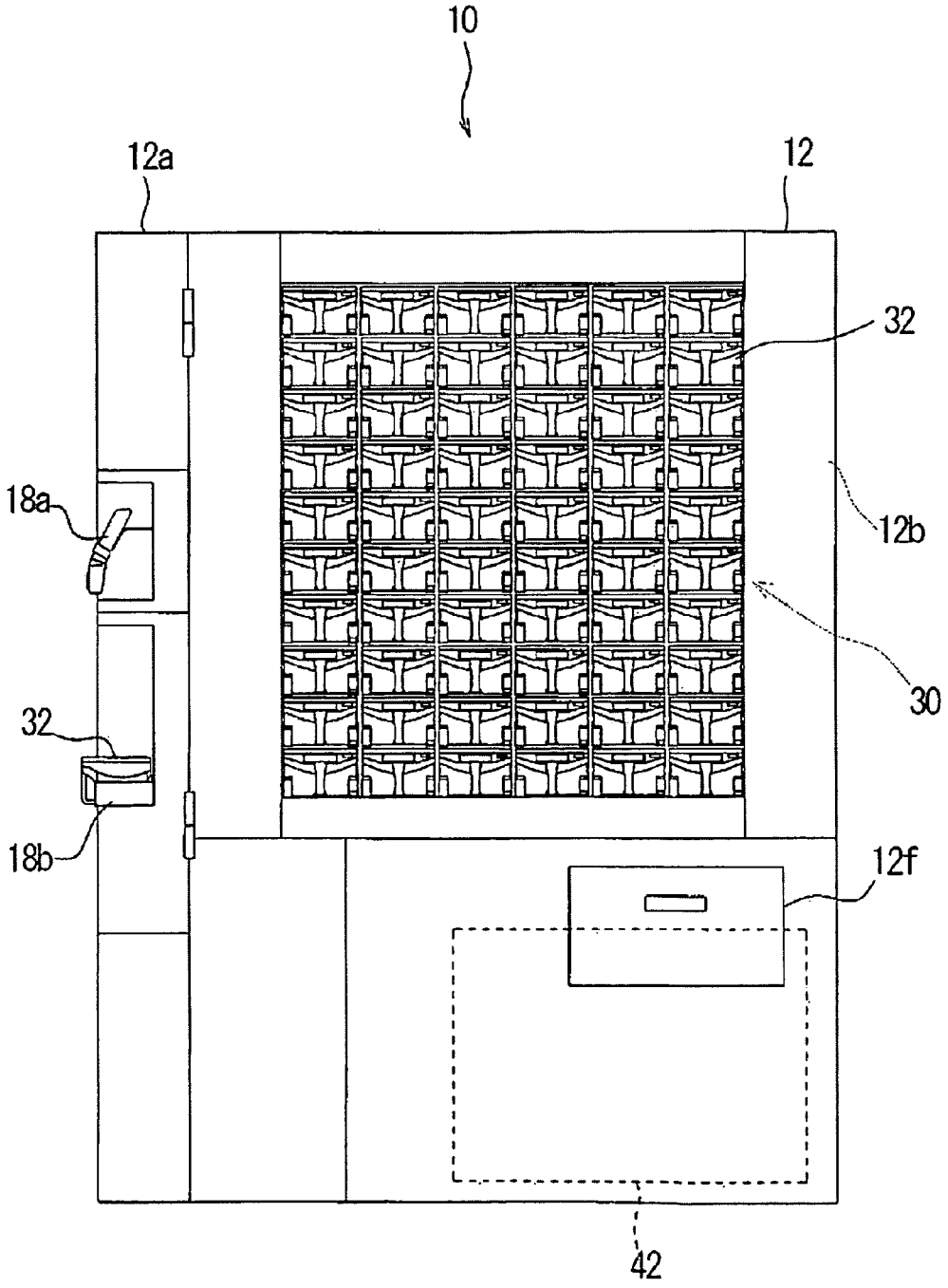
FIG. 2 is a side view of the medicament filling machine shown in FIG. 1.

As shown in FIG. 1 and FIG. 2, plural tablet cassettes 32 of a tablet feeding unit 30 described later have been provided in the device body 12, and can be easily attached or detached from the sides 12*b* and 12*c*. On the sides 12*b* and 12*c*, a door 12*f* is provided, and by opening this, vials B can be loaded randomly and stored in a vial supply unit 40 (see FIG. 5 and FIG. 6) (described later).

Figure 4:
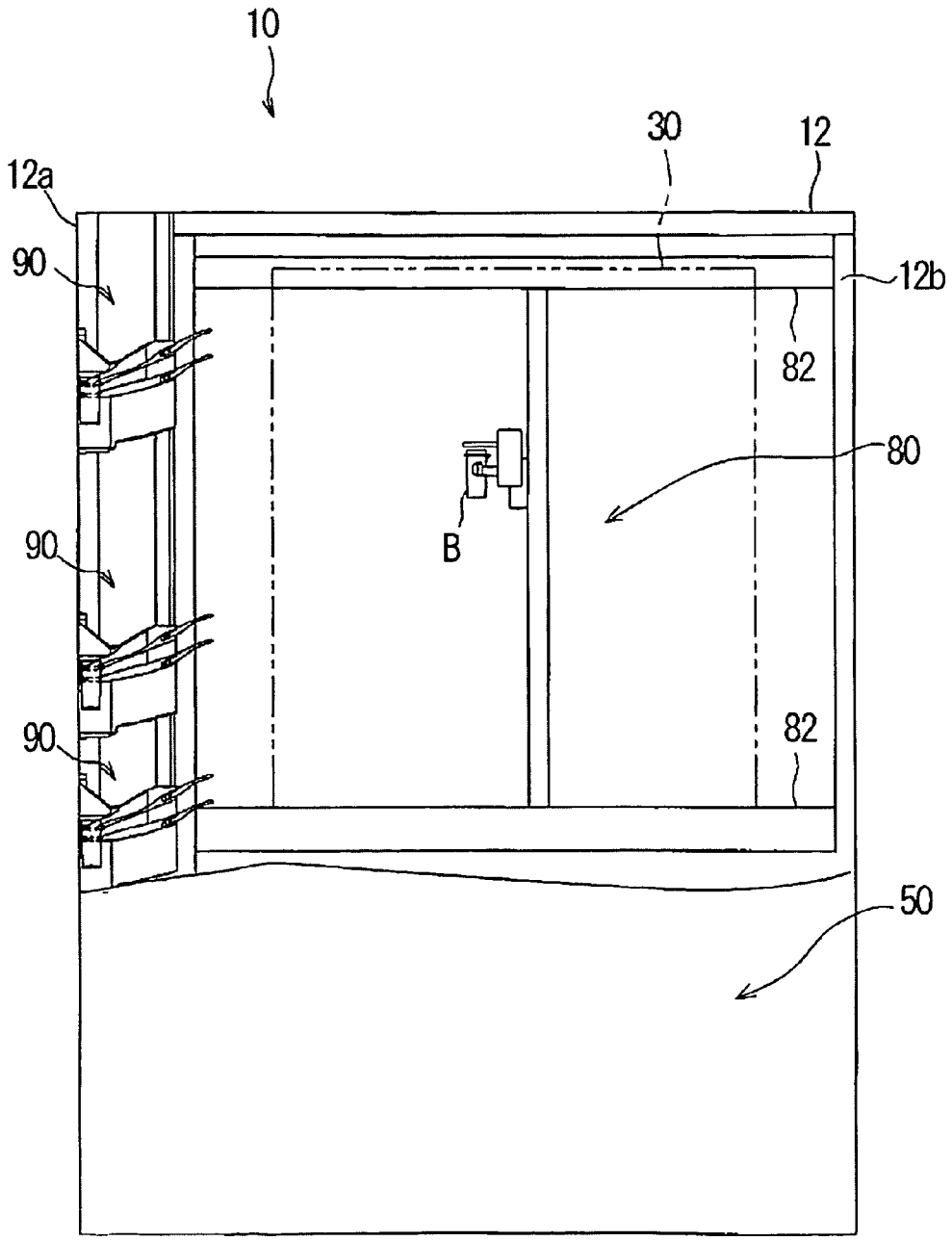
FIG. 4 is a side view showing the internal structure of the medicament filling machine shown in FIG. 1.
Figure 5:
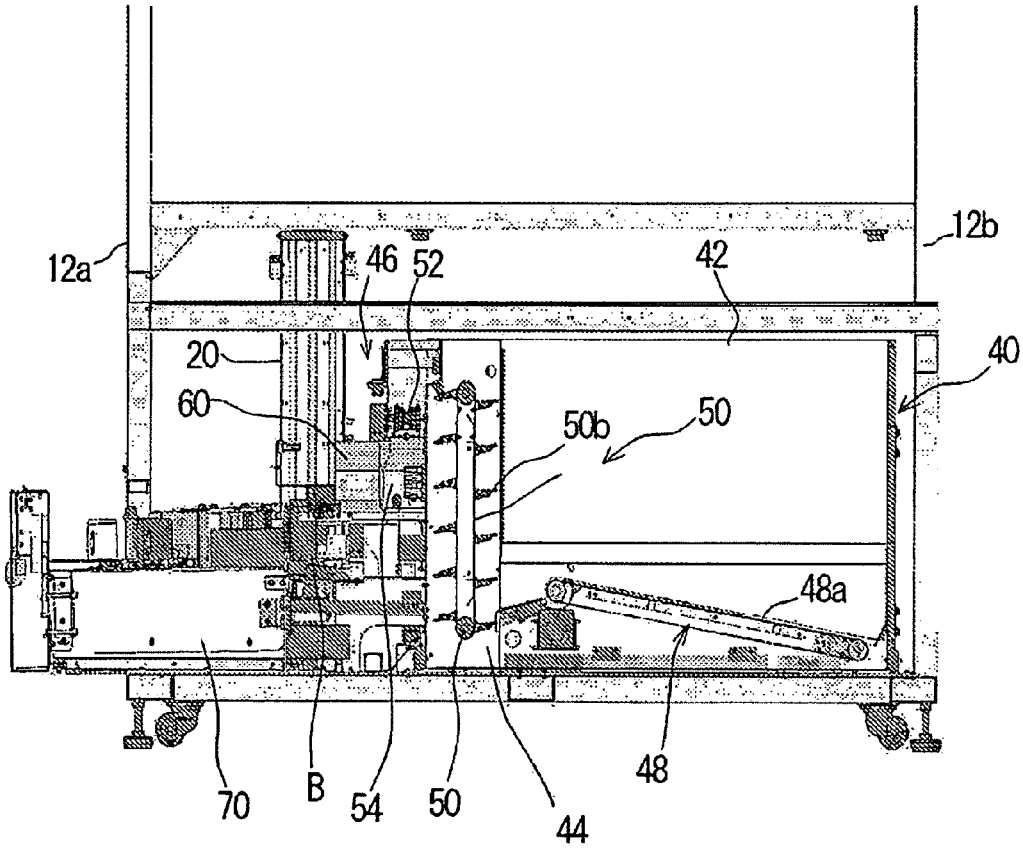
FIG. 5 is a side view showing the internal structure of the medicament filling machine shown in FIG. 1.
Figure 6:
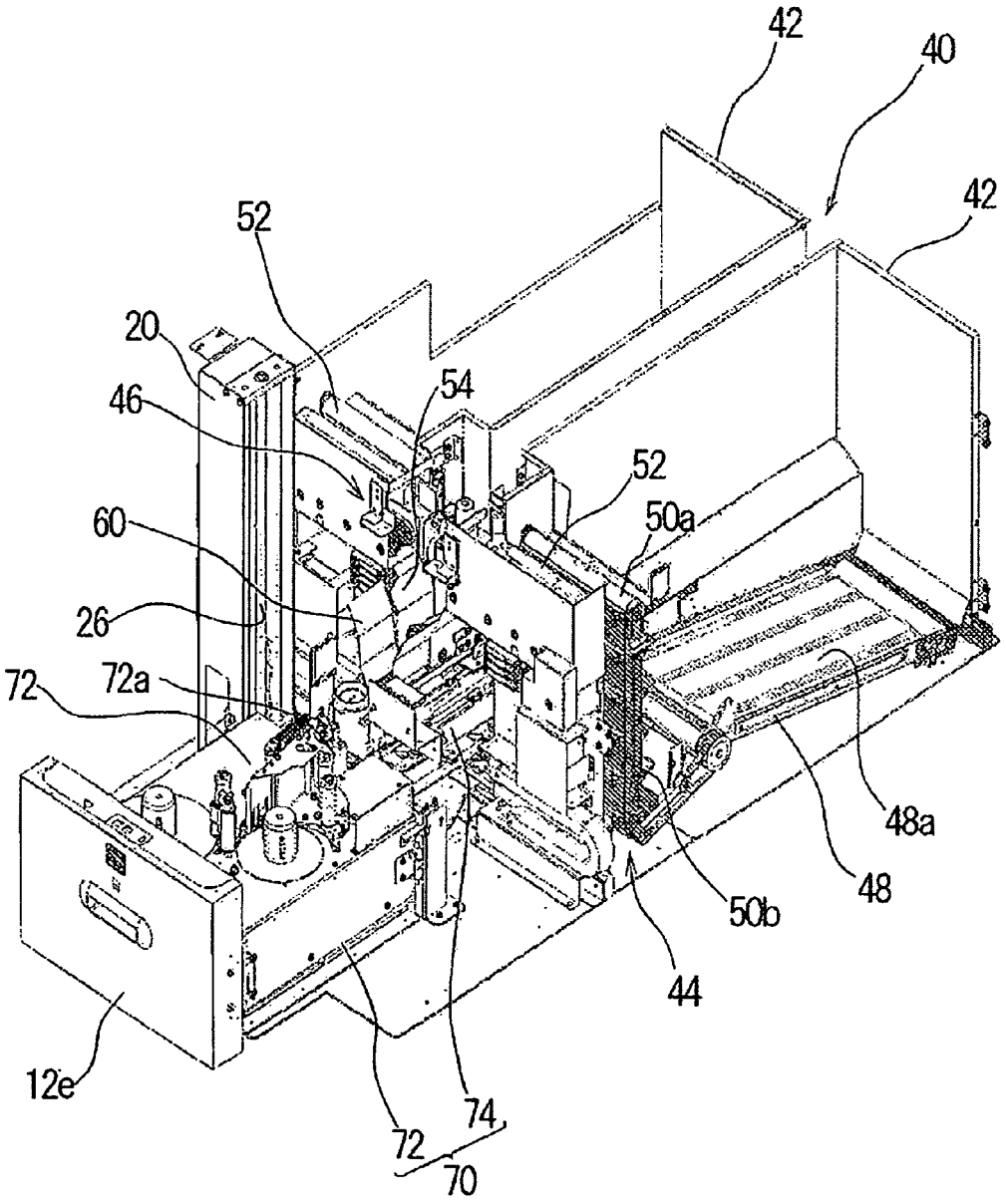
FIG. 6 is a perspective view of a vial supply unit, a labeling unit and a vial lifter.

As shown in FIG. 5 and FIG. 6, in the medicament filling machine 10, in addition to the tablet supplying unit 30 for filling the tablets in a vial B, there are provided a vial lifter in a bottom portion of the device body 12 for preparing a vial B, a vial supply unit 40, and a labeling unit 70. As shown in FIG. 4, in an upper portion of the device body 12 are provided a transporting unit 80 for conveying the vial B that was prepared below, and a discharge unit 90 to discharge towards the user the vial B filled with medicine by the tablet supply unit 30. The configurations of various parts are further described below.

As shown in FIG. 5 and FIG. 6, the vial supply unit 40 is provided with a stocker 42, an extraction mechanism 44 and a delivery mechanism unit 46. The stocker 42 is a vertical box provided for stocking the vial B. The stocker 42 is located in a lower portion of the device body 12 and near the sides 12*b* and 12*c*, and is installed near a rear side 12*d*. The vials B loaded through the draw door 12*f* can be randomly stored in the stocker 42.

The extraction mechanism 44 is provided for retrieving a vial B from the stocker 42, and is equipped with a conveyor 48, an extraction means 50 and a transfer means 52. The conveyor 48 is configured with an endless belt 48*a*. The conveyor 48 is installed at the bottom of the stocker 42 such that it is inclined in the upper direction towards the front side 12*a* of the device body 12. Therefore, by operating the conveyor 48, it is possible to move the vial B contained in the stocker 42 to the left side of FIG. 5 (front side 12*a*).

The extraction means 50 is for carrying up the vial B collected in the front side 12*a* by the conveyor 48 in the stocker 42, and for retrieving the vial B from the stocker 42. The extraction means 50 is configured with paddles 50*b* at fixed intervals on a drivable endless belt 50*a*, and is installed vertically along the inner wall of the front side of stocker 42. Therefore, by operating the extraction means 50, each paddle 50*b* moves sequentially in the upper direction while maintaining a horizontal posture. By moving the paddle 50*b* in the upper direction, the vial B in the front side 12*a* of the stocker 42 is carried up, and retrieved from the stocker 42.

Figure 7:
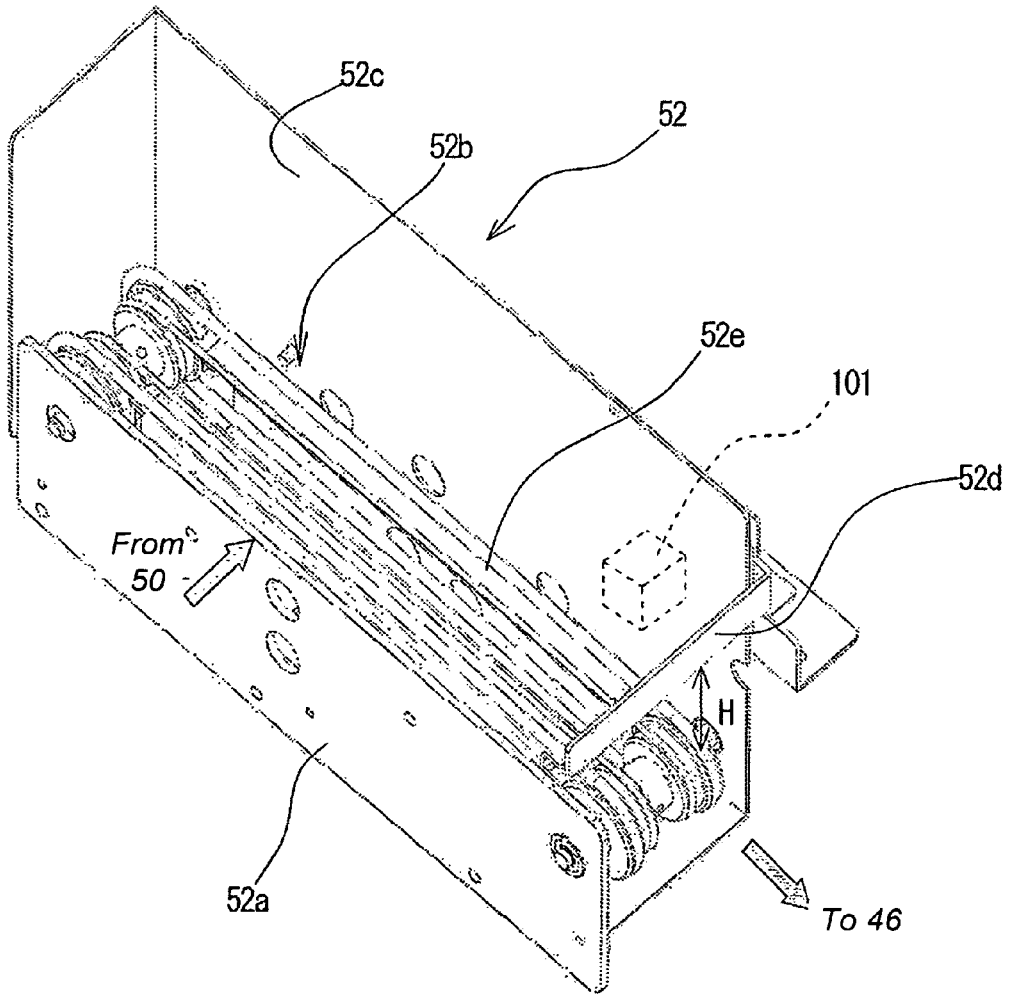
FIG. 7 is a perspective view of a transfer means.

The transfer means 52 is for conveying the vial B retrieved by the extraction means 50 towards the delivery mechanism unit 46. As shown in FIG. 7, the transfer means 52 is comprised of a frame 52*a* and a transfer conveyor 52*b*. The frame 52*a* is fitted along the upper end of front side 12*a* of the stocker 42, and a portion facing the stocker 42 is opened to facilitate acceptance of the vial B retrieved by the extraction means 50. On the frame 52*a*, a guide 52*c* is provided for preventing the popping out of vial B that was retrieved from the extraction means 50. Further, a butting piece 52*d* is installed in a shape of a cantilever on the frame 52*a*.

The transport conveyor 52*b* is fixed to the frame 52*a* described above. The transport conveyor 52*b* is installed such that an endless belt 52*e* forming a transport surface faces the top part of the stocker 42 through an open sections of the frame 52*a*. By operating the endless belt 52*e* by a power source (not shown), the transport conveyor 52*b* can dispatch the vial B towards the delivery mechanism unit 46.

Here, the butting piece 52*d* is provided in the transport conveyor 52*b* at a downstream side of the conveying direction. Further, the butting piece 52*d* is provided at a location that is higher by height H than the conveying surface of the transport conveyor 52*b* formed by the endless belt 52*e*. This height H is greater than the outer diameter DR of the vial B, but smaller than the height of the vial B. Accordingly, even if the vial B is in an upright posture at the instant when it was transferred from the extraction means 50 to the transport conveyor 52*b*, normally the vial B collides with the butting piece 52*d* in the downstream end of the transport conveyor 52*b*, and is transported in a laid condition to the delivery mechanism unit 46.

As shown in FIG. 6, the delivery mechanism unit 46 is installed almost in the middle of the device body 12, and is a featured part in the medicament filling machine 10. The delivery mechanism unit 46 is for delivering the vial B, which was dispatched by the transfer means 52 of the extraction mechanism 44 explained above, in an upright posture to the next process. The delivery mechanism unit 46 is provided with a loading means 54 (dispatch mechanism unit), a regulation means 56, and a supply means 60 (upright-delivery unit) provided in a location abutting the front side 12*a* of these means.

Figure 8:
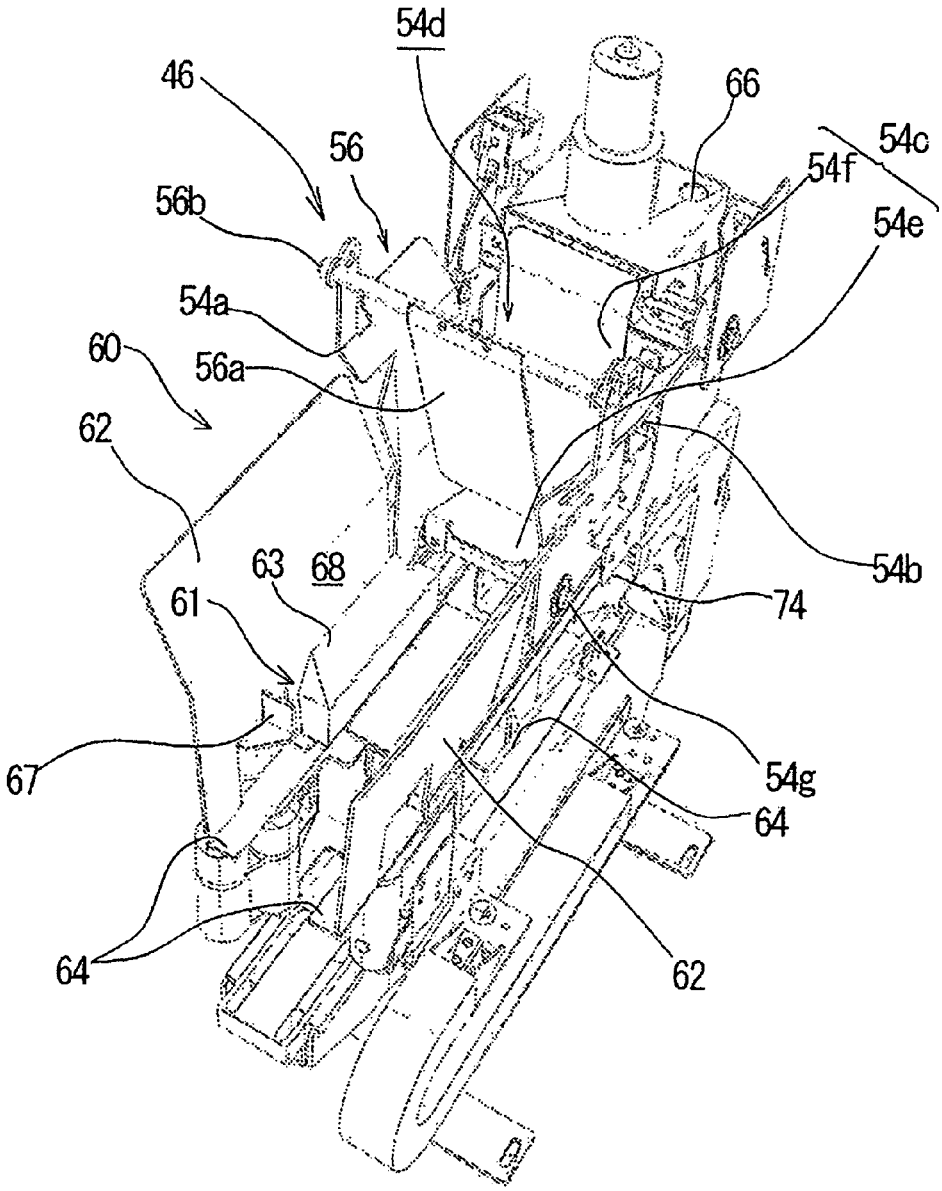
FIG. 8 is a perspective view of a loading means, a supply means, a pusher and the vial lifter.
Figure 9:
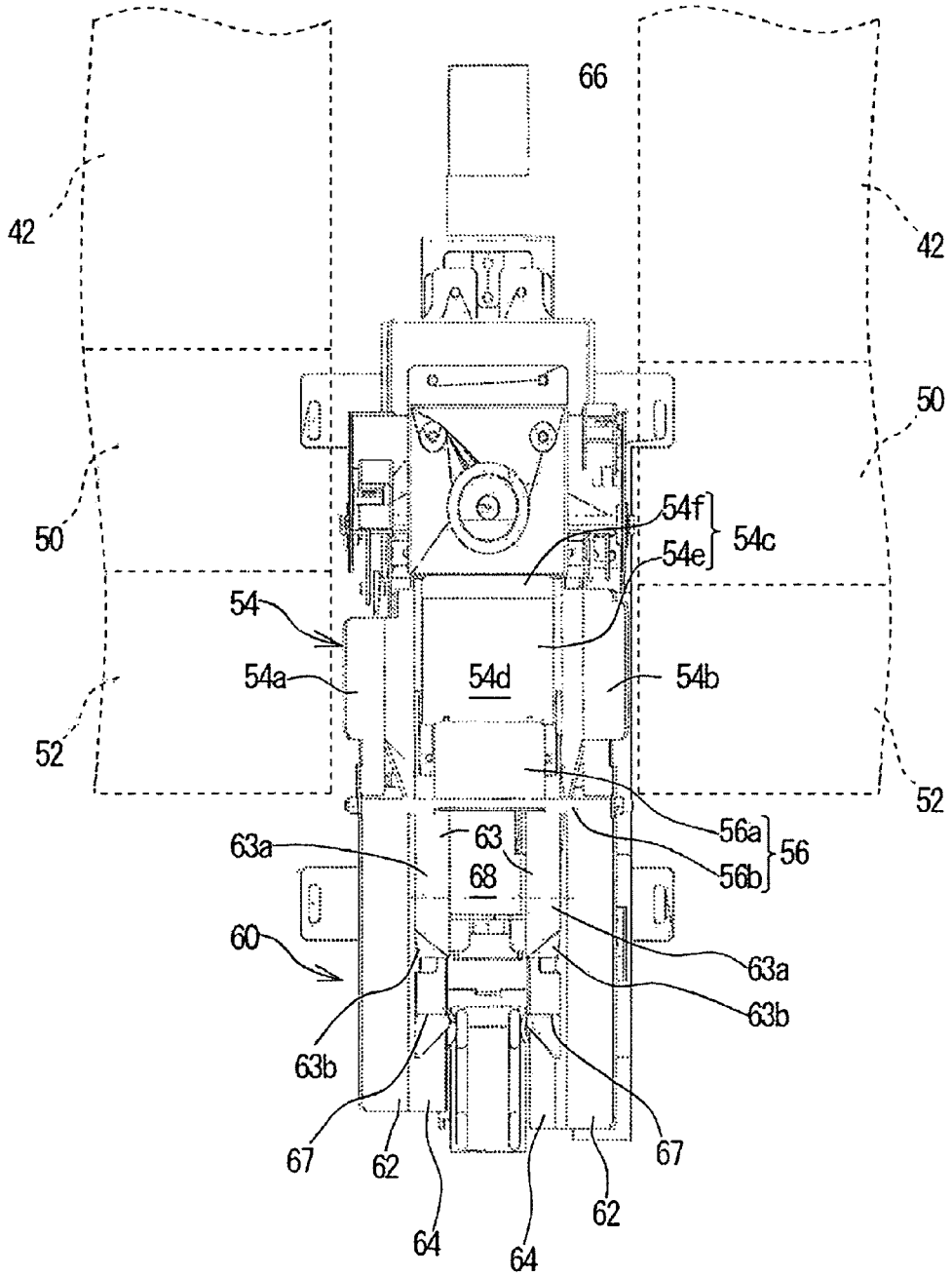
FIG. 9 is a plane view of the loading means, supply means, pusher and vial lifter.
Figure 10:
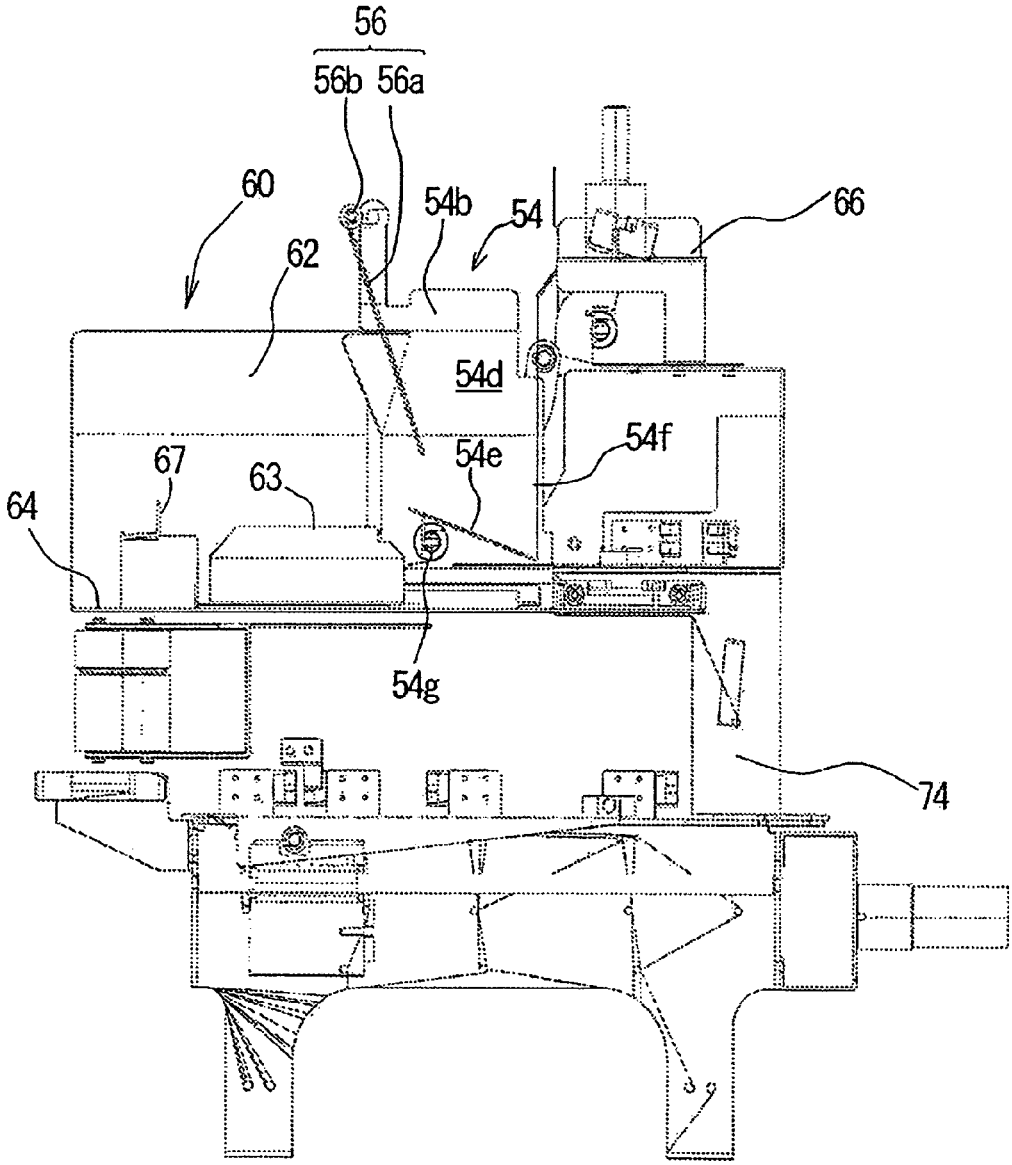
FIG. 10 is a side view of the loading means, supply means, pusher and vial lifter.

The loading means 54 is for receiving the vial B transported by the transfer means 52, and for dispatching and supplying this vial B to a supply means 60 provided on the downstream side (direction of front side 12*a*; lower left direction in FIG. 6). As shown in FIG. 8, the loading means 54 is comprised of a pair of guides 54*a* and 54*b*, and a loading strip 54*c*. As further shown in FIG. 9, the loading means 54 is installed in a location facing the downstream end of the transport conveyor 52*b* explained above. As shown in FIGS. 8-10, guides 54*a* and 54*b* are formed by folding a metal plate, and installed facing to each other by providing a gap larger than the diameter of the vial B. With this, a space 54*d* is created between the guides 54*a* and 54*b*. Due to this, when the transfer means 52 is operated, the vial B that is conveyed by this can be received in the space 54*d*. Further, the top end sections of the guides 54*a* and 54*b* extend towards the outside of the space 54*d*. Therefore, the vial B that is conveyed by the transport means 52 smoothly enters the space 54*d*.

The loading strip 54*c* is provided between the guides 54*a* and 54*b*, and is linked to a power source (not shown) via a power transmission mechanism such as a link mechanism. The loading strip 54*c* can be freely rotated around a support shaft 54*g* by operating the power source. As shown in FIG. 8 and FIG. 10, the loading strip 54*c* is formed by folding a metal plates in an approximately L shape, and comprises a bottom plate section 54*e* and a rear plate section 54*f*. The loading strip 54*c* is installed such that the bottom plate section 54*e* becomes the bottom surface of the space 54*d* formed between the guides 54*a* and 54*b*, and the rear plate section 54*f* blocks the rear side 12*d* of the space 54*d*. Further, the support shaft is fixed to the loading strip 54*c* at a location that is a backside of the bottom plate section 54*e* and a front portion of the bottom plate section 54*e* (front side 12*a*). Therefore, if the loading strip 54*c* is rotated around the support shaft 54*g*, the bottom plate section 54*e* and the rear plate section 54*f* will fall to the front side 12*a*. Therefore, if the loading strip 54*c* is operated when the vial B is put inside the space 54*d*, the vial B is pushed out by the loading strip 54*c*, and is loaded into the supply means 60 as if it is falling to the front side 12*a*.

As shown in FIG. 8-FIG. 10, the regulation means 56 is provided between the loading means 54 and supply means 60. The regulation means 56 contains a plate-shaped flap 56*a* (plate-like body). The upper portion of the flap 56*a* is supported by a support shaft 56*b* provided so as to bridge the gap between the guides 54*a* and 54*b*, and the flap 56*a* can be freely rotated around the support shaft 56*b*. The flap 56*a* hangs downward from the support shaft 56*b* at all times, and partly blocks the front side of the space 54*d* provided in the loading means 54. In other words, the space between the loading means 54 and supply means 60 is always partitioned by the flap 56*a*, and restricts the vial B from being dispatched unless the vial B is actively dispatched towards the supply means 60 after the vial B enters the space 54*d* (hereafter, this restricted state of vial B is referred as a bottle-standby state). That is, the regulation means 56 functions as a movement regulation means to regulate the vial B such that the vial B does not pop out of the space 54*d*. The regulation means 56 also has a function as a posture-controlling means for maintaining the posture of the vial B, which has entered the space 54*d*, in an upright posture. On the other hand, if the vial B is pushed towards the supply means 60 by operating the loading strip 54*c* of the loading means 54, the flap 56*a* is pushed by the vial B and revolves. Due to this, the space 54*d* will become connected to the supply means 60, and the vial B in the space 54*d* can be dispatched towards the supply means 60.

Figure 11:
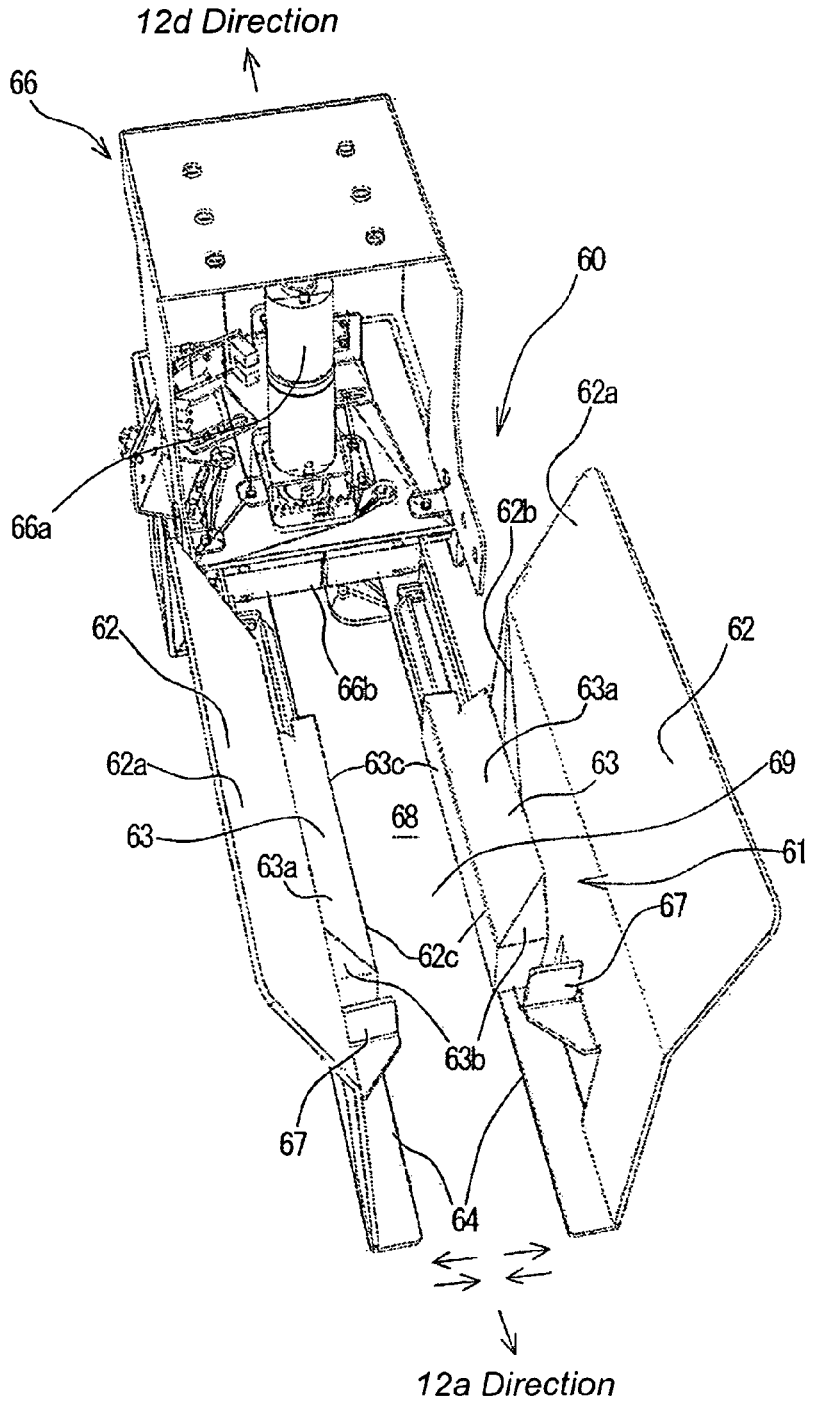
FIG. 11 is a perspective view of the supply means.

The supply means 60 is for dispatching the vial B, which is received from the loading means 54, in an upright posture with its opening orienting upward, and for supplying the vial B for a next process. As shown in FIG. 8 and FIG. 11, the supply means 60 is provided respectively with pairs of bottle receiving members 62, slide members 63, arms 64 and stoppers 67. In addition to these, the supply means 60 is provided with a drive mechanism unit 66.

The bottle receiving members 62 and 62 are formed respectively by bending metal plates, disposed to face to each other, and are installed in the middle of the arms 64 and 64. A vial pathway 68 is provided between the bottle receiving members 62 and 62. The arms 64 and 64 are made of the rod-shaped members and have L-shaped cross-sectional shapes. The arms 64 and 64 are installed respectively so as to extend in parallel from the front side 12*a* to the back side 12*d*. As shown in FIG. 10, the arms 64 and 64 are connected to the drive mechanism unit 66 through a lower place than the aforementioned loading means 54.

Figure 15:
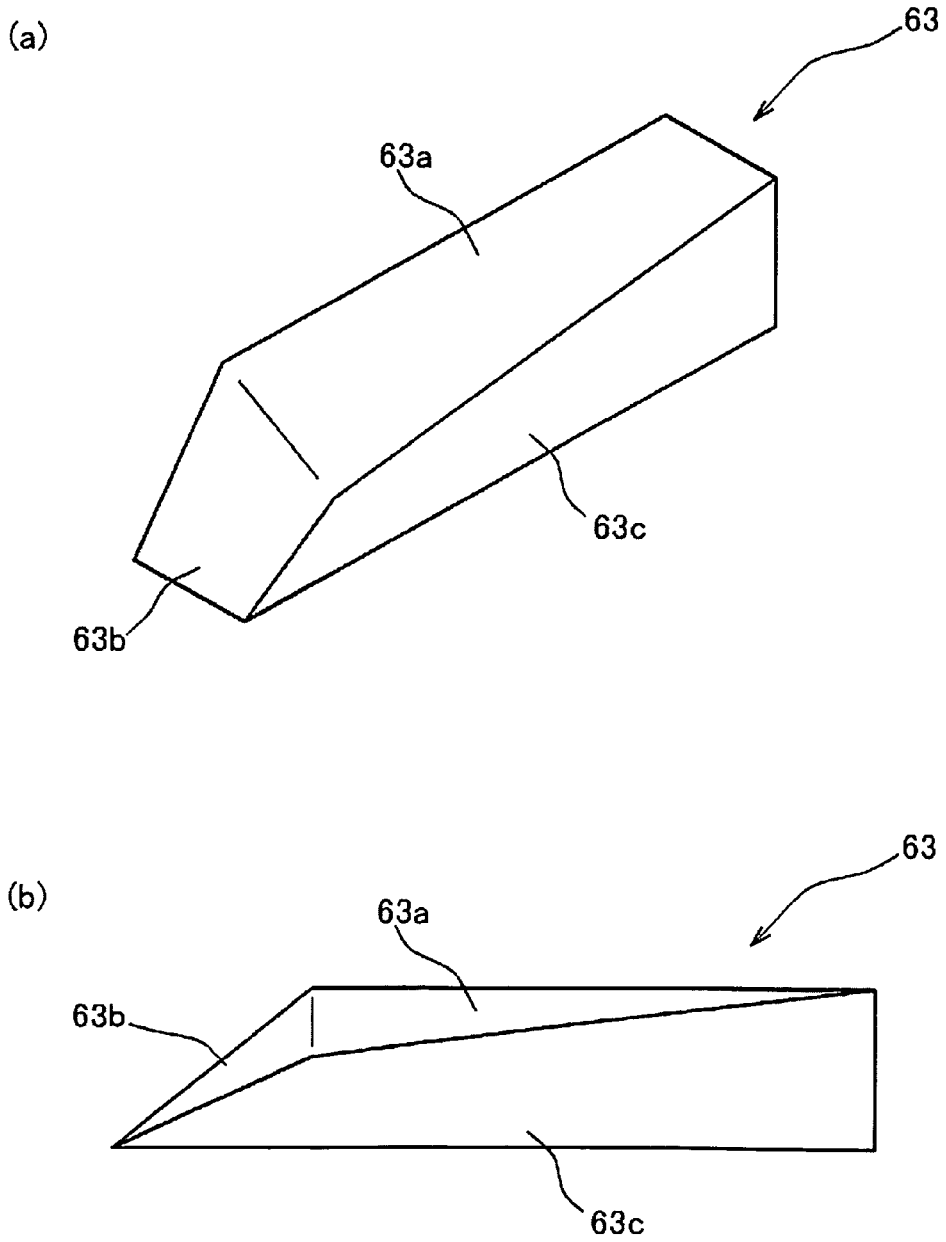
FIG. 15 (*a*) is a perspective view showing a slide member, and (*b*) is a side view of the slide member.

As shown in FIG. 8 and FIG. 11, one pair of slide members 63 and 63 constitute the slide section 61 where the vial B received through the loading means 54 slides. The slide members 63 and 63 are installed at the base end section of the aforementioned bottle receiving members 62 and 62 respectively so as to be along the arms 64 and 64. The slide members 63 and 63 of the slide section 61 are provided between the regulation means 56 and the stopper 67 respectively. The slide member 63 is made of resin and the frictional resistance with the vial B is small. Further, as shown in FIG. 15, the slide member 63 is a block-shaped member, and has a length that is about same as or slightly longer than the height of the vial B used in the medicament filling machine 10. The slide member 63 is comprised of a sliding surface 63*a*, a front end surface 63*b* (downward slope section), and a side surface 63*c*. As shown in FIG. 8, FIG. 10 and FIG. 11, the respective sliding surfaces 63*a* and 63*a* orient in the upper direction in the state where the slide members 63 and 63 are installed. Therefore, if the vial B is dispatched from the loading means 54 to the supply means 60, the vial B slides on these sliding surfaces 63*a* and 63*a*.

Figure 12:
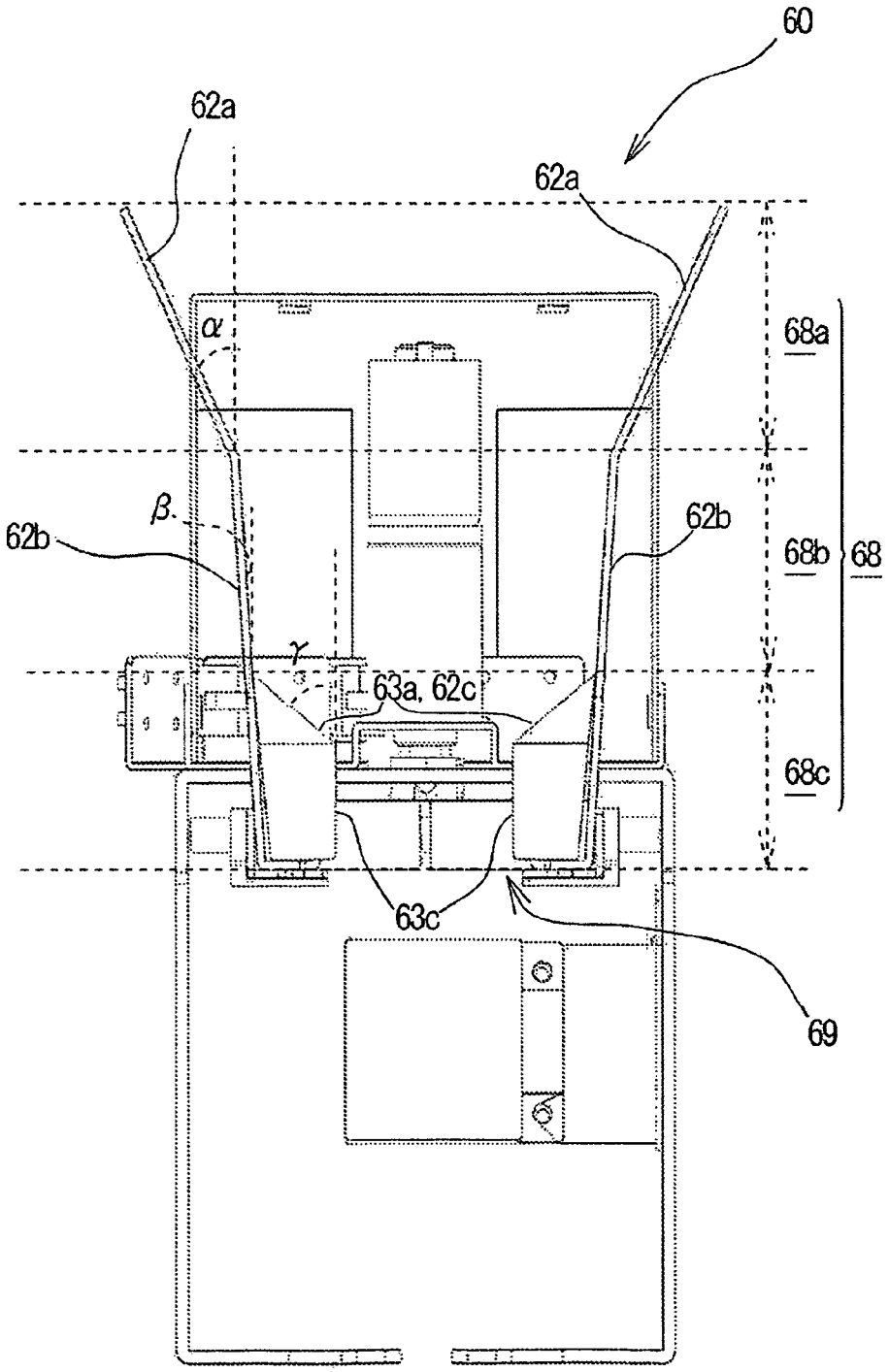
FIG. 12 is a front view showing positional relationships of the bottle receiving members of the supply means.

As shown in FIG. 8, FIG. 11 and FIG. 12, the sliding surfaces 63*a* and 63*a* incline respectively towards the inside of the vial pathway 68. Therefore, the passage width of the vial pathway 68 tapers down in the location where the sliding surfaces 63*a* and 63*a* are provided. That is, the vial pathway 68 is in the form of a taper in the section where the sliding surfaces 63*a* and 63*a* are formed. Further, the sliding surfaces 63*a* and 63*a* are formed so as to incline downwards as they become distant from the delivery mechanism unit 46. In other words, the sliding surfaces 63*a* and 63*a* incline downwards as they approach the downstream side of the movement direction (hereafter, referred as 'bottle movement direction') of the vial B from the loading means 54 to the supply means 60. Therefore, if the vial B enters from the delivery mechanism unit 46 into the supply means 60 and gets on the sliding surface 63*a* and 63*a*, the vial B slides towards the downstream side (front side 12*a*) by slowly descending along the downward slope formed by the sliding surfaces 63*a* and 63*a*.

The front end surface 63*b*, with the slide member 63 attached, is formed at the downstream end of the bottle movement direction (hereafter, also referred as 'tip'). The front end surface 63*b* is a continuous surface of the sliding surface 63*a*, and inclines downward toward the tip of the slide member 63. The slope of the front end surface 63*b* towards the bottle movement direction is larger than the slope of the sliding surface 63*a* in the bottle movement direction. Therefore, the slide member 63 has a steeper downward slope at the tip across the boundary of the sliding surface 63*a*. Thus, if the vial B approaches the front end surfaces 63*b* and 63*b*, and crosses their boundaries, the posture of the vial B changes to an upright posture under the influence of its own weight balance.

The side surfaces 63*c*, with the bottle receiving members 62 and 62 attached to the base end section, are almost vertical, and are surfaces that are orienting towards the inside of the vial pathway 68. If one pair of the slide members 63 and 63 is attached to the bottle receiving members 62 and 62, the sides 63*c* and 63*c* mutually face to each other, and a feed port 69 is formed for discharging the vial B from the vial pathway 68 and delivering to the next process.

As shown in FIG. 8, the stopper 67 has a function of preventing popping out of the vial B, and is formed by partially bending a metal plate constituting the bottle receiving member 62. The stopper 67 is a strip-shaped extra portion protruding towards the inside of the vial pathway 68, and functions as a barrier for preventing the scampering away of the vial B that comes sliding over the slide member 63. The stopper 67 is provided in supply means 60 at a location adjacent to the downstream side of the bottle movement direction with a predetermined gap from the aforementioned slide member 63. As described above, since the length of the slide member 63 is about same or slightly longer than the height of the vial B used in the medicament filling machine 10, the distance from the regulation means 56 to the stopper 67 is also set to be about same or slightly longer than the height of the vial B. Therefore, the vial B dispatched from the loading means 54 is delivered in a sufficiently fallen state in the space between the stopper 67 and the boundary of the regulation means 56 and the supply means 60. Further, the stopper 67 is located on the extension of the sliding surface 63*a* formed on the slide member 63, and is formed to almost same height as that of the sliding surface 63*a*. Therefore, even if the vial B dispatched from loading means 54 onto the sliding surface 63*a* tries to pop out from the supply means 60, the vial B hits the stopper 67 and does not pop out.

The gap formed between the tip 63*b* of the slide member 63 and the stopper 67 is adjusted such that the vial B does not get stuck at the stopper 67 during the process wherein the posture of the vial B becomes a vertical state along the tip 63*b*, and also to fully demonstrate the function of the stopper 67 to prevent the popping out of the vial B.

The drive mechanism unit 66 is provided in a location adjacent to the rear side 12*d* with respect to the aforementioned loading means 54. The drive mechanism unit 66 is provided with a motor 66*a* and housing 66*b*. This drive mechanism unit 66 operates when the power of the motor 66*a* is relayed to a drive mechanism (not shown) provided in the housing 66*b*. When the drive mechanism in the housing 66*b* operates, as shown by the arrows in FIG. 11, the gap between the arms 64 and 64 and between the bottle receiving members 62 and 62 attached to the arms 64 and 64 is increased or decreased, maintaining them parallel to each other.

In the supply means 60, the space between the bottle receiving members 62 and 62 where the slide member 63 is provided functions as a vial pathway 68 where the vial B dispatched from the loading means 54 is received and forwarded. As shown in FIG. 12, the vial pathway 68 is overall a tapered pathway, and the pathway width gradually decreases from top to bottom. The vial pathway 68 can be mainly divided into three regions of different rates of decline of pathway width (hereafter, called as 'taper ratio D'). More specifically, the vial pathway 68 is divided into various regions such as an upper end part 68*a*, intermediate part 68*b* and lower end part 68*c* from top to bottom, and each region is tapered.

The upper end part 68*a* is a part of the upper region of the vial pathway 68, and is provided to prevent the vial B, which comes tumbling by the operation of the loading means 54, from wrongly popping out of the supply means 60. As shown in FIG. 12, the surface constituting the upper end part 68*a* in the bottle receiving member 62 (hereafter, also called as 'upper end inner wall 62*a*') inclines at an angle α with respect to the vertical direction, and inclines so that the vial pathway 68 becomes a taper shape as it goes downwards.

The intermediate part 68*b* is a section continuing downward from the upper end part 68*a*, and is the part for the entry of the vial B that comes tumbling from the loading means 54 located at the rear side 12*d* towards the supply means 60 located at the front side 12*a*. As shown in FIG. 12, the surface constituting the intermediate part 68*b* in the bottle receiving member 62 (hereafter, also called as 'passage inner wall 62*b*') exists in a location lower than the bend portion forming the boundary of the upper end inner wall 62*a*, and has an inclination steeper than that of the upper end inner wall 62*a*. Specifically, the passage inner wall 62*b* forms an angle δ with the vertical direction (α>β), and is nearly vertical. That is, regarding the rate of decline of the width of the vial pathway 68 (hereafter, called as 'taper ratio D') in the downward direction, that of the intermediate part 68*b* is smaller than that of the upper end part 68*a*. The width of the passage way in the intermediate part 68*b* is adjusted to be slightly larger than size fitting to the vial B. Therefore, the vial B that comes tumbling from the loading means 54 does not get stuck in the upper end part 68*a* or intermediate part 68*b*, and smoothly tumbles into the intermediate part 68*b*.

The lower end part 68*c* is a part existing still further below the intermediate part 68*b*, and provided with a feed port 69. Further, the surface that constitutes the lower end part 68*c* in the bottle receiving member 62 (hereafter, also called as 'supply unit inner wall 62*c*') is constituted with the sliding surface 63*a* and the side surface 63*c* of the aforementioned slide member 63. The slide member 63 is fixed such that the sliding surface 63*a* of the supply unit inner wall 62*c* is continuous with the bottom end of the passage inner wall 62*b*. The sliding surface 63*a* of the supply unit inner wall 62*c* and the side surface 63*c* are mutually continuous. Therefore, the sliding surface 63*a* functions as a guide that guides the vial B, which comes tumbling to the intermediate part 68*b*, towards the feed port 69. The inclination of the supply unit inner wall 62*c* is more gradual than that of the passage inner wall 62*b*. More specifically, in this embodiment, the supply unit inner wall 62*c* forms an angle γ with the vertical direction (γ>α>β), and the inclination of the supply unit inner wall 62*c* is made more gradual than the inclination of the passage inner wall 62*b* and the inclination of the upper inner wall 62*a*. Therefore, the taper ratio D of the passage width in the lower end portion 68*c* is larger than the taper ratio D in upper end part 68*a* and intermediate part 68*b*. Moreover, the angle γ between the supply unit inner wall 62*c* and the vertical direction can be suitably changed according to the outer diameter DR of the vial B used for the medicament filling machine 10 of this embodiment, and it is preferable to adjust the angle such that the sliding of the vial B that came tumbling in the vial pathway 68 is not obstructed, and the vial B is not bounce back.

Here, in the supply means 60, the gap between the bottle receiving members 62 and 62, in other words, the width of the opening of vial pathway 68 is adjusted such that the vial B fits snugly in the intermediate part 68*b* but the vial B does not fall through the feed port 69 provided in the lower end part 68*c* until the supply means 60 receives the vial B from the loading means 54. Therefore, at the instance when the vial B is loaded from the loading means 54 and comes tumbling, the vial B is in a state wherein the vial B is lying on the sliding surface 63*a* of the slide member 63 (supply unit inner wall 62*c*). After the vial B enters the vial pathway 68, the supply means 60 operates the drive mechanism unit 66, and the gap between the bottle receiving members 62 and 62 is widened such that the opening width of the feed port 69 is about same or slightly larger than the outer diameter DR of the body of the vial B. Here, since the bottom portion of the vial B is closed, its center of gravity is biased in the bottom side. Therefore, if the opening width of the feed port 69 becomes wider, the vial B naturally becomes upright in a posture wherein the bottom is oriented downwards and the mouth is oriented upwards, and becomes a state where the bottom portion protrudes downward out of the feed port 69. Further, the vial pathway 68 of the supply means 60 is opened towards the front side 12*a*. Therefore, if the vial B is made slide from rear side 12*d* to the front side 12*a*, it is discharged from the feed port 60 in an upright state with the mouth orienting towards top, and delivered for the next process.

As shown in FIG. 6, the labeling unit 70 is provided with a label printer 72 (labeling means) and pusher 74. The label printer 72 is for pasting a label on the outer surface of the vial B, and as shown in FIG. 6, is provided in a location abutting the front side 12*a* with respect to the aforementioned supply means 60.

Figure 13:
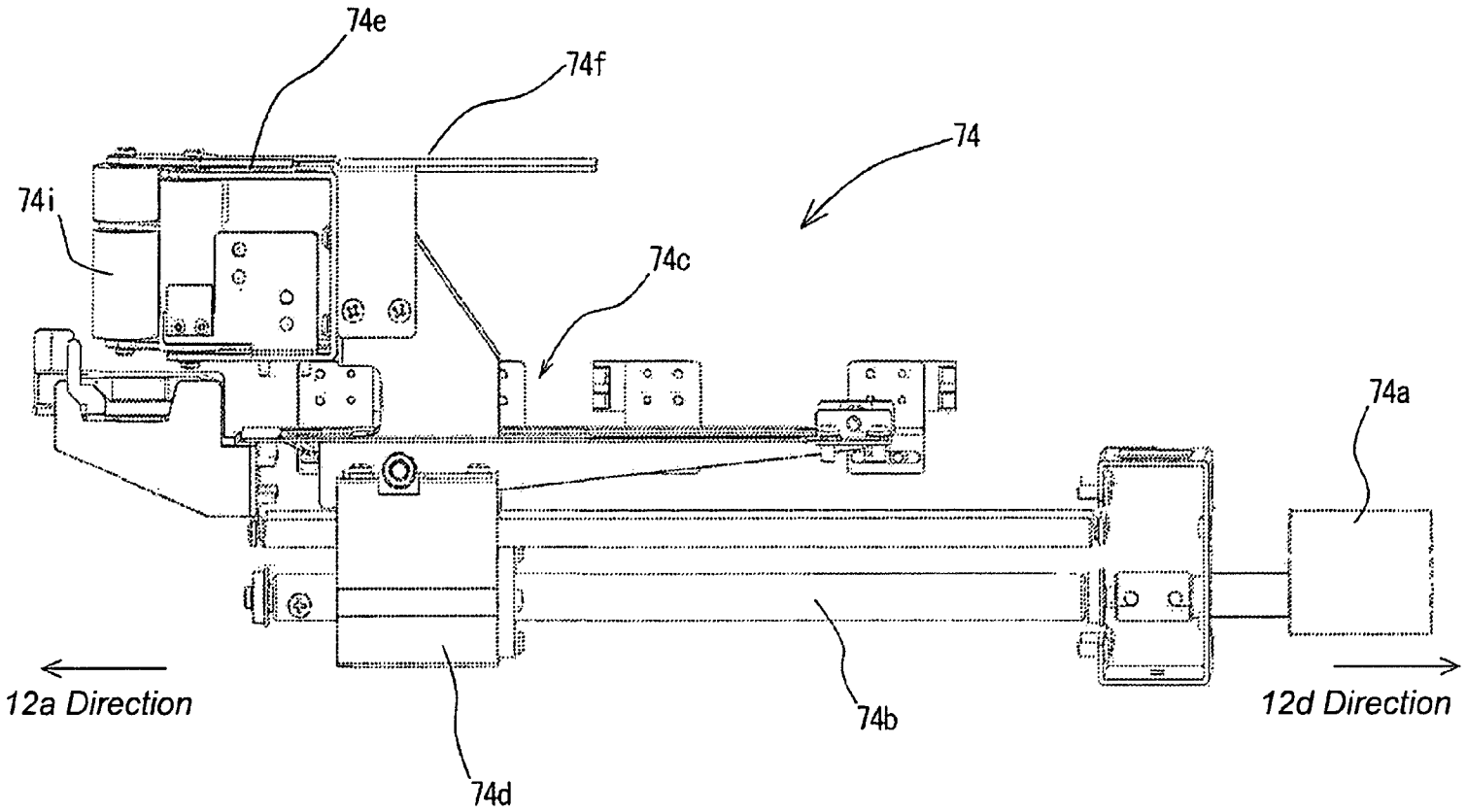
FIG. 13 is a side view showing the structure of the pusher.
Figure 14:
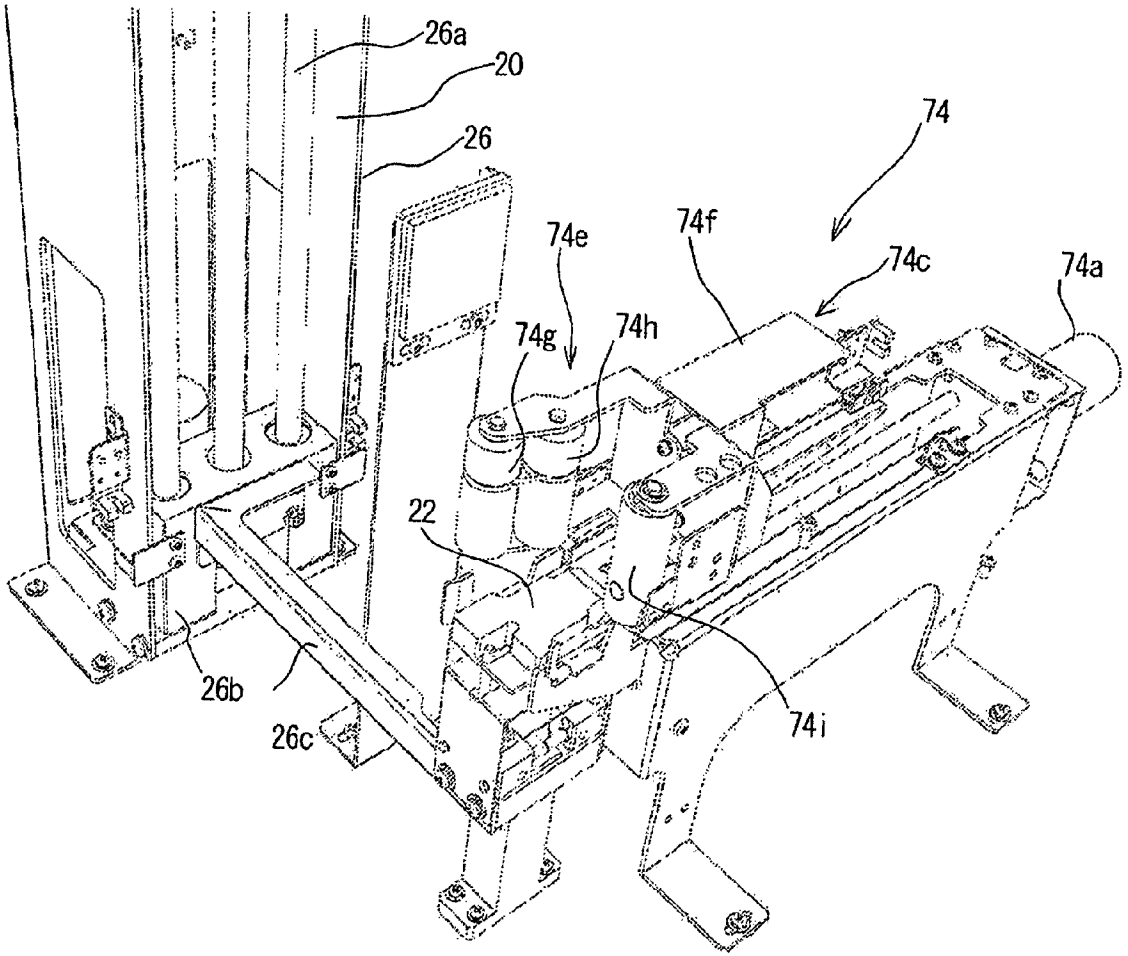
FIG. 14 is a perspective view of the pusher and vial lifter.

The pusher 74 is for contacting from rear side 12*d* the body section of the vial B that has emerged in an upright posture in an downward direction from the discharge port 69 of the supply means 60 and is in standby state, and for pushing the vial B towards the label printer 72 that is in front of the supply means 60. As shown in FIGS. 8 and 10, the pusher 74 is disposed underneath the loading means 54 and the supply means 60 described above. Further, as shown in FIG. 13 and FIG. 14, the pusher 74 is provided with a motor 74*a* as a power source, and contains a ball screw 74*b* driven by this, and a pusher body 74*c* connected to this. The pusher body 74*c* is disposed in a location lower than the feed port 69 of the supply means 60 described above.

As shown in FIG. 13, the pusher body 74*c* is provided with a drive body 74*d*, a press 74*e*, and a fall-prevention section 74*f*. The ball screw 74 is inserted into the drive body 74*d*, and screwed to each other. Therefore, by rotating the ball screw 74*b* by operating the motor 74*a*, the drive body 74*d* is moved linearly back and forth towards the front side 12*a* and rear side 12*d*. The press 74*e* and fall-prevention section 74*f* are fixed at the top of the drive body 74*d*. The press 74*e*, as viewed from top, has three freely rotating rollers 74*g*-74*i* installed on a U-shaped frame, and disposed so as to be able to contact with the side surface of the vial B. If the press 74*e* reaches below the feed port 69 of the supply means 60 that is provided above, the vial B can be discharged to a location adjacent to the front side 12*a* corresponding to the rollers 74*g*-74*i*.

The vial lifter 20 is provided with a lifting table 22, which carries the vial lifter B that was supplied from the supply means 60, and a lifting mechanism 26 for lifting the lifting table 22. The lifting mechanism 26, as shown in FIG. 14, is installed in a location adjacent to the lifting bench 22, and comprises a guide rod 26*a* that can extend in upper and lower directions, and a lifting block 26*b* mounted on this. In addition, the lifting bench 22 is installed to the lifting block 26*b* via an arm 26*c*. Therefore, if power is conveyed to the lifting block 26*b* from a power source that is not shown, the lifting bench 22 slides in upward and downward directions along the guide rod 26*a* with the lifting block 26. If the lifting table 22 is moved in the upper direction, the vial B placed on this lifting table 22 can be transferred to the transport unit 80.

As shown in FIG. 1 and FIG. 2, the tablet supply unit 30 is provided on both sides 12*b* and 12*c* of the device body 12, and is provided at a location higher than where the above-described vial supply unit 40 is provided. The tablet supply unit 30 contains tablet cassettes 32 from which stored tablets are supplied. The medicine supplied from the tablet cassette 32 is supplied into the space between the tablet supply units 30 and 30 provided on both sides 12*b* and 12*c* of the device body 12.

The transport unit 80 moves the vial B received from the vial lifter 20 in the space between the tablet supply units 30 and 30 provided on both sides (sides 12*b* and 12*c*) of the device body 12 with the vial's opening orienting in the upward direction. Therefore, by moving the vial B by the transport means 80 to the dispensing port (not shown) of the tablet cassette 32 containing the medicine to be filled with, it is possible to fill medicine in vial B.

The transport unit 80 can convey the vial B filled with the tablets in the tablet supply unit 30 to the discharge unit 90. The vial B conveyed to the discharge unit 90 can be retrieved by a user through retrieval windows 14*a*-14*c*.

The medicament filling machine 10 of this embodiment features the operations involved in retrieving an empty vial B from the stocker 42 to supplying the vial B via the supply means 60. More explicitly, if the medicament filling machine 10 becomes in a state wherein it can fill medicine in the vial B and ready for delivery, first the extraction means 50 and the conveying means 52 operates, and the vial B is retrieved from the stocker 42, and conveyed towards the first loading means 54.

As described above, the vial B that is conveyed towards the loading means 54 is loaded in the space 54 provided between the guides 54*a* and 54*b*, and placed on the loading strip 54*c*. During this, although it is not sure whether the opening of the vial B is orienting upward or downward in the space 54*d*, it is loaded in an upright posture in the space 54*d*. After the loading of the vial B in the space 54*d* is completed, the loading strip 54*c* rotates around the supporting shaft 54*g*. During this, the loading strip 54*c* and the vial B that is standing on this loading strip 54*c* rotate about 90° around the support shaft 54*g* in the direction of the supply means 61 which is located in the front side 12*a* In this process wherein the loading strip 54*c* and the vial B rotates around the support shaft 54*g*, the vial B and the rear plate section 54*f* of the loading strip 54*c* comes in contact with the regulation means 56 provided in the space between the loading means 54 and supply means 60 If the loading means 54 further rotates form this state, the flap 56*a* constituting the regulation means 56 is pressed by the vial B or the rear plate section 54*f* and rotates around the support shaft 56*b*.

The loading strip 54*c* rotates till the bottom plate section 54*e* is erected to be a near vertical orientation, and the rear plate portion 54*f* collapses towards the inside of the vial pathway 68 and becomes almost horizontal orientation. In this process, the flap 56*a* rotates and becomes an open state such that the vial B is able to pass through, and the vial B is pushed down by the loading means 54 and is dispatched to the supply means 60. In this manner, the vial B is loaded in the vial pathway 68. If the vial B enters the supply means 60, the loading strip 54*c* rotates in the reverse direction around the support shaft 54*g*, and returns to original posture. Moreover, coordinating with this, the flap 56*a* also returns to original state, and the loading means 54 and supply means 60 are separated by the flap 56*a*.

Here, as described above, till the vial B is loaded, the width of the opening of the intermediate part 68*b* is larger than the outer diameter DR of the body of the vial B and the flange at the opening end of the vial B, and is of a size such that the vial B can fit snugly. However, the opening width of the feed port 69 provided in the lower end part 62 is not of a size for the vial B to pass through. Therefore, as described above, in the process of dispatching the vial B from the loading means 54 to the supply means 60, the vial B, while sliding over the sliding surface 63*a* of the slide member 63 attached to the lower end part 62 without getting stuck, enters the intermediate part 68*b* in a laid state. Since the stopper 67 is provided on the extended place of the sliding surface 63*a* in the vial pathway 68*b*, the vial B does not pop out beyond the stopper 67.

If the vial B enters the intermediate part 68B, the vial B sits on the sliding surface 63*a*. Here, the sliding surface 63*a* of the slide member 63, as described above, is inclined so as to provide a downward slope towards the downstream of bottle movement direction. Therefore, the vial B that has entered the intermediate part 68*b* tends to move along the inclination of the sliding surface 63*a* towards the downstream of bottle movement direction. Since the inclination of the front end surface 63*b* of the slide member 63 is made steeper than the inclination of the sliding surface 63*a*, if the vial B approaches the front end of the slide member 63, the vial B which was in the tumbled state at the time of entering the intermediate part 68*b* tries to change the orientation to be an upright posture naturally. Moreover, when the vial B enters the intermediate part 68*b* of the vial pathway 68, the drive mechanism unit 66 of the supply means 60 operates, and the gap between the swinging arms 64, 64 and bottle receiving members 62, 62 widens. As a result, the gap between the slide members 63 and 63 provided in the lower end portion 68 of the vial pathway 68 as well as the opening width of the feed port 69 also increase, and eventually become less than the outer diameter of the flange (not shown), which is about the same size or slightly larger than the outer diameter DR of the body of the vial B and which is provided at the upper end portion of the vial B. Further, the center of gravity of the vial B is biased towards the bottom because of factors such as its bottom is sealed and there is an opening at the top. Due to these reasons, if the vial B enters the intermediate part 68*b*, this vial B subsequently rotates and becomes an upright posture with the bottom orienting naturally downwards and the opening orienting upwards, and the flange of the vial B is mounted on and supported by the swing arms 64 and 64, and the body protrudes from the feed port 69.

Thus, if the body section of the vial B protrudes from the feed port 69, the pusher 74 operates. The vial B, wherein the flange is supported by the swing arms 64 and 64 and the body section is protruding downwards, is pushed from the rear side 12*d* towards the front side 12*a*, and discharged from the feed port 69. The vial B discharged from the feed port 69 is pasted with a label in the label printer 72, and moved by the vial lifter 20 and transporting unit 80. In this process, the vial that has been empty is filled with a certain medicine. When the filling of medicine to the vial B is finished, this vial B is moved to the discharge unit 90 by the transporting unit 80, and can be ready to be retrieved from the retrieval window 14.

In the medicament filling machine 10 of this embodiment, when the loading means 54 is in a bottle-standby state which is capable of receiving the vial B, the flap 56*a* of the regulation means 56 laterally partitions the space between the guides 54*a* and 54*b*, and the movement of the vial B from the loading means 54 to the supply means 60 is restricted. Therefore, in the medicament filling machine 10, when the vial B is transported from transfer means 52 to the loading means 54 and is fallen, popping out of the vial B towards supply means 60 by the falling force is prevented by the regulation means 56. Therefore, when moving the vial B from loading means 54 towards the supply means 60, failures due to this vial B popping out to unexpected places will not occur.

Further, in the aforementioned medicament filling machine 10, the regulation means 56, in addition to functioning as a movement regulation means for regulating the movement of vial B, also functions as a posture regulation means to regulate the posture of the vial B entering the space 54*d* in an upright state. Therefore, in the medicament filling machine 10, in the space 54*d* surrounded by the regulation means 56 and guides 54*a* and 54*b* and loading strip 54*c* (bottom plate section 54*e*, rear portion 54D, it is possible to temporarily steady the body posture of the vial B, and dispatch the vial B towards the supply means 60 after rearranging the posture. Therefore, according to the above configuration, when the vial B is dispatched from the loading means 54, failures such as the vial B becoming in an unexpected posture, or getting stuck in unexpected locations will not occur. Moreover, in the example shown in above embodiment, the regulation means 56 was provided with both functions as movement regulation means and posture regulation means. However, the present invention is not limited to this, and only either of the functions may be provided. Further, the function or configuration of the movement regulation means or the posture regulation means may be supplemented by other members.

In the medicament filling machine 10 of this embodiment, the flap 56*a* supported by and freely-rotatable around the support shaft 56*b* is used. When the loading means 54 is in the bottle-standby state, the space between the loading means 54 and the supply means 60 is partitioned by the flap 56*a*, resulting in a state wherein the vial B cannot move from the loading means 54 to the supply means 60. The space 54*d* is made of a size such that the vial B can fit in snugly in an upright posture. Therefore, if the vial B is loaded in the space 54*d* when the loading means 54 is in the bottle-standby state, the vial B eventually becomes steadied in the upright posture. In the above embodiment, since the loading means 54 has a configuration in which the vial B is discharged towards the supply means 60 by making the vial B tumbling, the vial B is always fed into the vial pathway 68 of the supply means 60 in a collapsed state. Therefore, according to the configuration shown in the above embodiment, it is possible to feed (discharge) the vial B in a determined posture to the loading means 54 and supply means 60, and failures such as the vial B is jammed due to unexpected postures will not occur.

The above embodiment has a configuration wherein when the loading means 54 discharges the vial B towards the supply means 60, the restriction for the movement of vial B by the regulation means 56 can be released by pressing and rotating the flap 56*a* by the rear plate part 54*f* of the loading means 54 or by the vial B. Therefore, according to the above configuration, it is not necessary to provide a power source for opening and closing the flap 56*a*, or for controlling the opening and closing of the flap 56*a*. In the above embodiment, although the configuration of pressing and moving the flap 56*a* by the loading means 54 or the vial B was shown, the present invention is not limited to this, and a configuration may be adopted wherein a separate power source may be used for operating the regulation means 56, or the opening and closing of the regulation means 56 may be controlled independently from the operation of loading means 54. In the regulation means 56, the flap 56*a* was supported by the supporting shaft 56*b* to rotate freely. However, the present invention is not limited to this, and the flap 56*a* may be substituted with a gate or stopper that can be appropriately opened and closed.

In the above embodiment, the stopper 67 is provided to the slide member 62 in the downstream of bottle dispatch direction of the vial B. Therefore, even if the vial B is dispatched by pressing and opening the flap 56*a* of the regulation means 56 by the vial B or the loading strip 54*c* of the loading means 54, the vial B does not pop out from the supply means 60.

As in the above embodiment, when the regulation means 56 is opened or closed by opening or closing the flap 56*a* by the vial B or loading strip 54*c*, the resistance to movement of the vial B increases to the moved amount of the flap 56*a*. In the above embodiment, the stopper 67 was provided by taking an account of the consideration that the vial B may be furiously dispatched from the loading means 54 due to the increased movement resistance of vial B. However, the present invention is not limited to this, and the stopper 67 may not have to be installed in the case where such a large force to pop out the vial B from the supply means 60 is not applied to the vial B when the vial B is dispatched from the loading means 54 to the supply means 60.

In the above embodiment, by taking an account of the consideration that the regulation means 56 acts as a resistance to the movement during the movement of the vial B, when the vial B is dispatched from the loading means 54 to the supply means 60, the vial B slides on the slide section 61 comprising the pair of slide members 63 and 63 provided in the supply means 60 so that the vial B moves smoothly. The slide member 63 is made of resin like vial B so that the vial B can smoothly slide. Therefore, according to the aforementioned configuration, during the course of dispatch of the vial B from the loading means 54 to the supply means 60, the vial B moves smoothly, and failures such as the vial B dispatched from the loading means 54 getting stuck will not occur. In the above embodiment, although the example of the configuration of the slide section 61 was provided with the pair of slide members 63 and 63, both of which has a configuration similar to each other, the present invention is not limited to this, and configurations different from the above are possible. For example, only one slide member 63 is provided as described above whereas the other is not installed, or the other is of rectangular shape.

In the aforementioned embodiment, although the slide member 63 is provided separately from the bottle receiving member 62, and the slide member 63 is fixed to the bottle receiving member 62 and swinging arm 64, the present invention is not limited to this, and the slide member 63 may be integrally molded with the bottle receiving member 62. When this configuration is adopted, although the bottle receiving member 62 and slide member 63 are made of a same material, the item equivalent to the slide member 63 may also be formed of a metal plate like bottle receiving member 62. On the other hand, if the bottle receiving member 62 and slide member 63 are made as an integrated molded article, it is also possible to mold the section equivalent to the bottle receiving member 63 with a resin. If the items corresponding to the bottle receiving member 62 and slide member 63 are integrated as mentioned above, the number of parts decreases, and the manufacturing process can be simplified. If both the bottle receiving member 62 and slide section 63 are integrally molded from resin, not only in the section corresponding to the slide section 63 but also in the section corresponding to the bottle receiving member 62, the frictional resistance to the vial B decreases, and the vial B can be moved more smoothly. As described above, in case of a configuration of providing and installing the slide member 63 separately from the bottle receiving member 62, it is possible to provide the slide member 63 as an optional part for the already existing bottle receiving member 62.

As described above, if the sliding surface 63*a* is formed on the slide member 63 so as to incline downwards towards the downstream direction of the movement of the vial B, the vial B dispatched from the loading means 54 smoothly slides along the inclination of the sliding surface 63*a*, and there will be no occurrence of failures such as the vial B getting stuck or jammed on the way. As shown in the above embodiment, by forming the gap between the sliding surfaces 63*a* and 63*a* provided on the pair of slide members 63 and 63 such that it gradually increases towards the downstream side of the movement direction of the vial B, the vial B can be made slide more smoothly on the sliding surfaces 63*a* and 63*a*, and reliably prevent the vial B from getting stuck. Moreover, in the above embodiment, in order to make the sliding of the vial B on the slide member 63 better, the sliding surfaces 63*a* and 63*a* were provided so as to respectively incline downwards towards the downstream side of the movement direction of the vial B, or the gap between the sliding surfaces 63*a* and 63*a* were provided so as to broaden towards the downstream side of the movement direction of the vial B. However, the present invention is not limited to this, and the sliding surface 63*a* may not incline in the downward direction, or the gap between the sliding surfaces 63*a* and 63*a* may not broaden in a taper shape.

In the above embodiment, the gap between the sliding surfaces 63*a* and 63*a* (lower end inner walls 62*c* and 62*c*) gradually decreases as it goes down in the vial pathway 68, in other words, the lower end section 68*c* of the vial pathway 68 tapers in the downward direction. Therefore, by operating the swinging arms 64 and 64 in the state where the vial B is lying on the slide members 63 and 63, and increasing the opening width of the feed port 69, the vial B smoothly transitions to be an upright posture.

The loading means 54 in the above embodiment has a configuration wherein the vial B is tumbled by rotating the loading strip 54*c* and forwarded to the supply means 60, the vial B may bounce back or slide on the slide member 63, and return to the loading means 54 due to the effect of shock at the time of loading. In this case, if there is a gap below the loading strip 54*c*, failures are possible because the vial B enters under the loading strip 54*c* and gets stuck. If such circumstance is predicted, it is preferable to provide some measures to prevent the vial B forwarded to the supply means 60 from going under the loading strip 54*c*.

Figure 16:
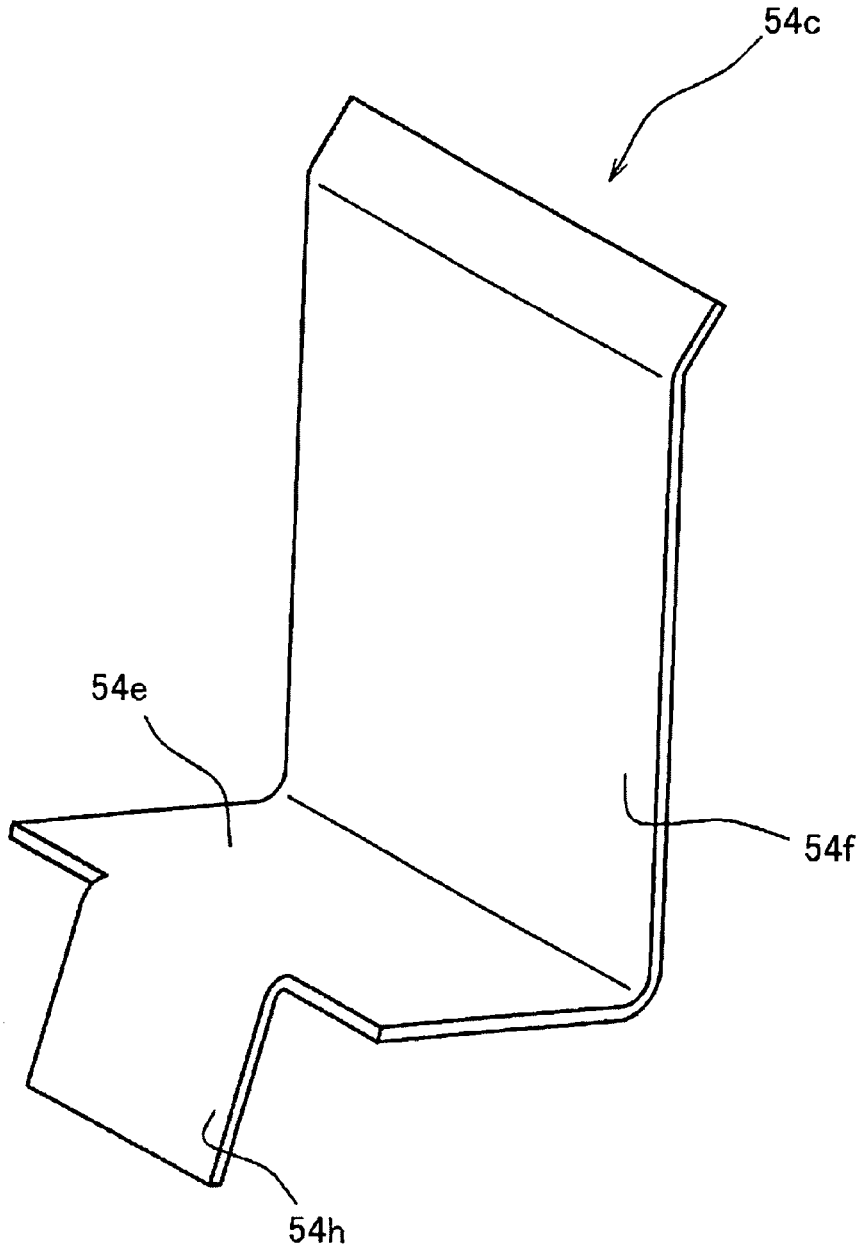
FIG. 16 is a perspective view of a modified example of a loading strip.
Figure 17:
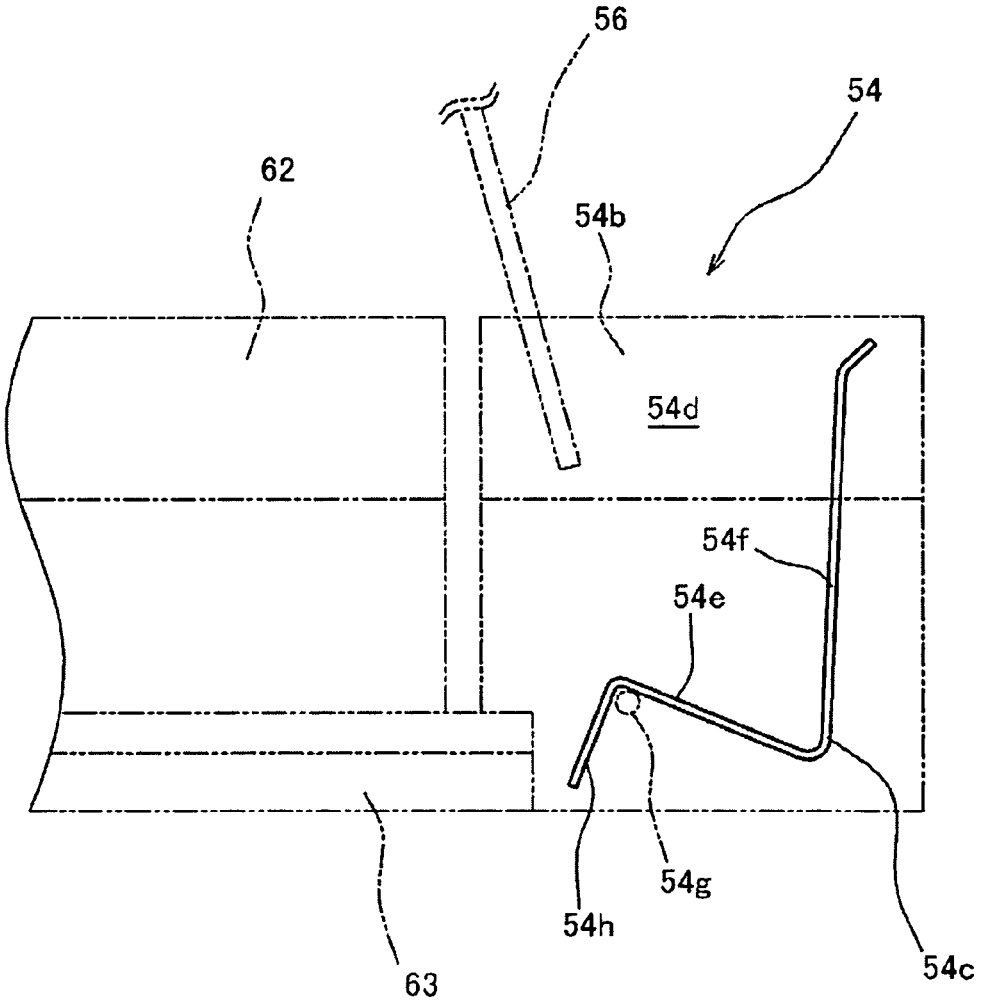
FIG. 17 is a side view showing the installed status of the loading strip shown in FIG. 16.

As a measure to prevent the vial B forwarded to the supply means 60 from entering under the loading strip 54*c*, for example as shown in FIG. 16, it is possible to configure the loading strip 54*c* provided with an intrusion restraining piece 54*h* (bottle restraining means) extending from the edge of the bottom plate section 54*e*. If the vial B forwarded to the supply means 60 is thought to return towards the loading means 54 by sliding on the slide member 63, as shown in FIG. 17, it is preferable that the intrusion restraining piece 54*h* is existing on the extended line of slide member 63 provided in the supply means 60. The intrusion restraining piece 54*h* is preferably approximately of a size such that a gap for possible intrusion of the vial B is not created in the space formed below the bottom plate section 54*e*, and is preferably as large as possible within the range where it does not obstruct the operation of the loading strip 54*c*.

Figure 18:
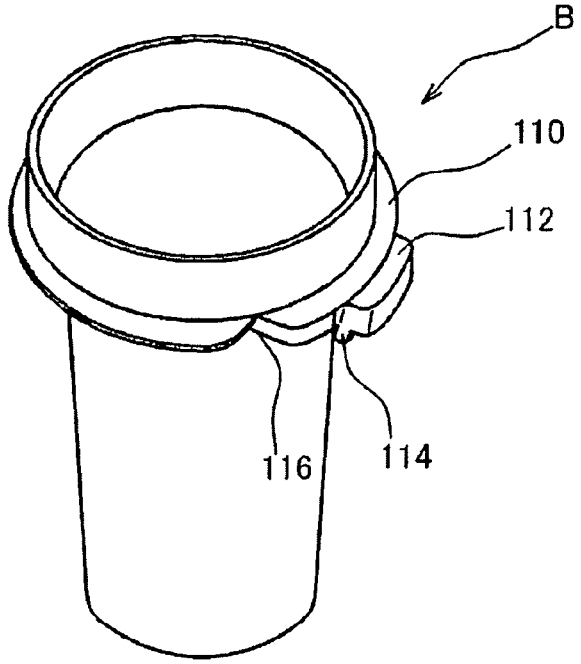
FIG. 18 (*a*) is a perspective view showing a vial, and (*b*) is a magnified perspective view of the top end section of the vial.
Figure 18:
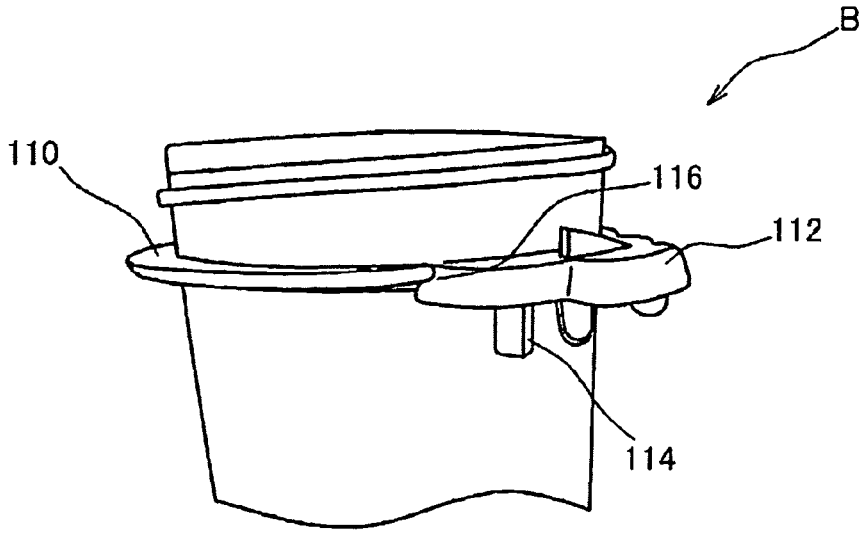

Here, as shown in FIGS. 18 (*a*) and (*b*), it is common that the vial B is provided with a fixed part 112 for attaching a flange 110 or a lid (not shown) to the upper portion, and various types of dents and projections such as a projection like a rib 114, and a recess 116 formed in the boundary between the flange 110 and the fixed part 112. Therefore, for a smooth discharge of the vial B in an upright posture from the supply means 60 when the gap between the slide members 62 and 62 is increased, it is desirable that the dents and projections provided on the vial B are configured to be difficult to get stuck on the slide member 63. Based on this finding, in the slide member 63 shown in the above embodiment, the front end surface 63*b* is provided so as to be continuous with the sliding surface 63*a*, and this front end surface 63*b* is provided so as to incline downwards towards the tip of the slide member 63. Therefore, it is difficult for the dents and projections such as recess 116 and rib 114, to get stuck on the slide member 63, and failure of descent of the vial B (discharge failure) rarely occurs.

Figure 19:
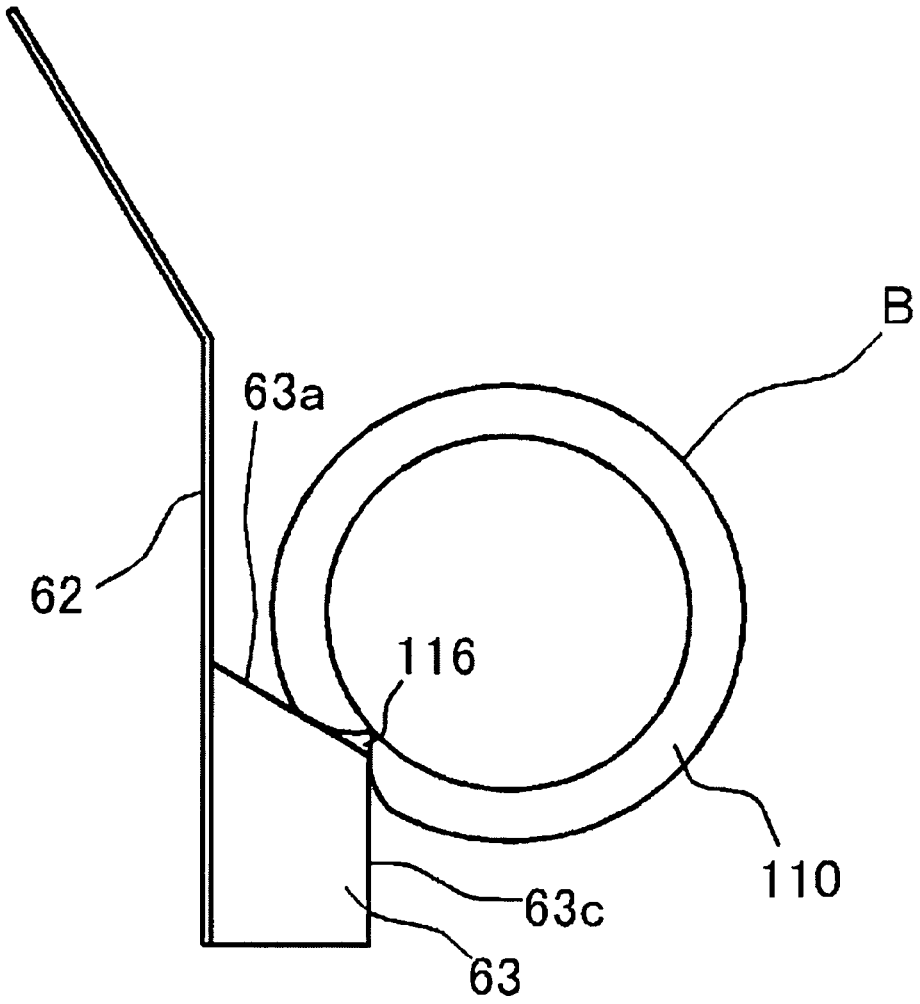
FIG. 19 is a side view showing the recessed section of the vial trapped in the slide member.

More specifically, if there were no configuration corresponding to the front end surface 63*b* on the slide member 63, and the end portion of the slide member 63 were configured with a near-vertical surface, as shown in FIG. 19, it would be possible that the corner section of the slide member 63 formed by the sliding surface 63*a* and side surface 63*c* would contact or engage with the recess 116 provided at the upper end of the vial B. In such a circumstance, even if the gap between the bottle receiving member 62 and 62 is increased to discharge the vial B, it is possible that the recess 116 gets stuck on the slide member 63, and it may not be possible to descend (discharge) the vial B. Since the vial B has not only the recess 116 but also dents and projections such as the fixed part 112 or rib 114, there is a risk of posture change or descent (discharge) obstruction of the vial B because the dents and projections may get stuck in an unexpected orientation.

However, the slide member 63 employed in this embodiment is provided with the front end surface 63*b* comprised of the inclined surface in the front end section, and since it is tapered, even if the recess 116 of the vial B comes in contact, the vial B naturally slides along the front end part 63*b* in the downward direction and does not get stuck. When the vial B slides along the front end portion 63*b*, due to the effect of its own weight balance, the position of the vial B naturally switches over to be upright. Therefore, if the front end surface 63*b* is provided at the tip of the slide member 63 and the slide member 63 is made in the form of taper, even when the vial B having the flange 110, or fixed part 112, and dents and projections such as rib 114 and recess 116, is used, it is possible to smoothly discharge the vial B from the slide member 60.

Moreover, in the above embodiment, the slide member 63 is made in the shape of a taper by providing the tip portion 63*b* inclined towards the tip. Thereby, the dents and projections in the outer periphery of the vial B is prevented from becoming stuck. The present invention is not limited to this, and instead of the slide member 63, for example a slide member having a shape shown in FIGS. 20 (*a*) and (*b*) may also be used.

Figure 20:
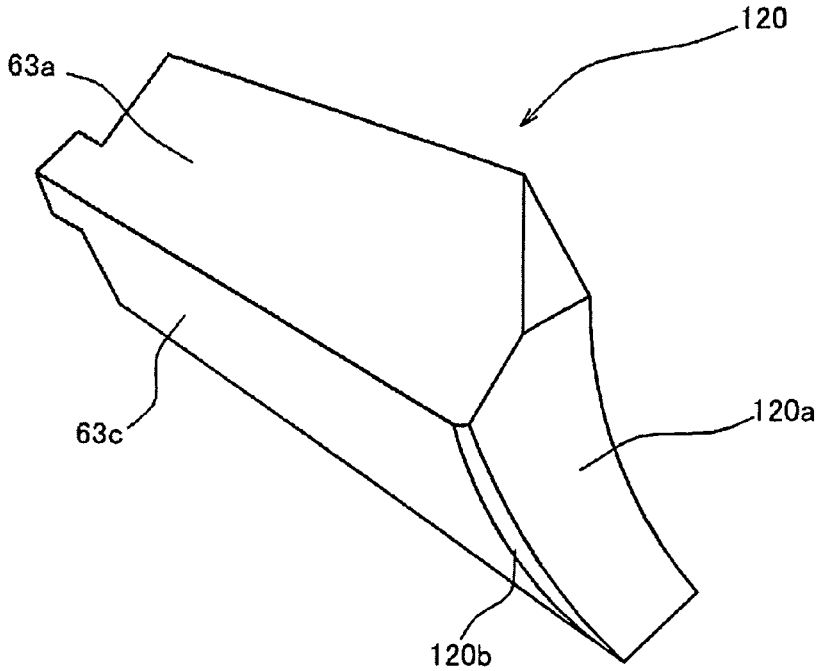
FIG. 20 (*a*) is a perspective view showing a modified example of a slide member, and (*b*) is a side view of the slide member.
Figure 20:
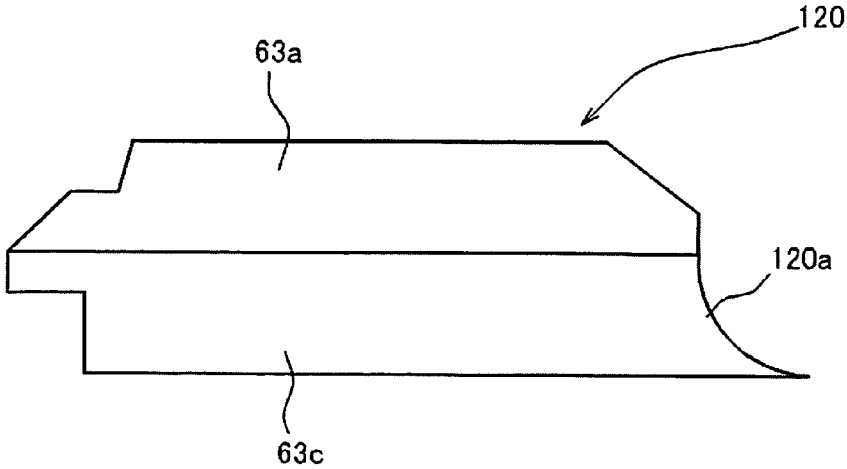

Specifically, although the slide member 120 shown in FIGS. 20 (*a*) and (*b*) contains a sliding surface 63*a* and side surface 63*c* as the slide member 63 described above, it has a curved surface 120*a* (downward inclination section) curved in the downward direction instead of the front end surface 63*b*, and the ridge 120*b* that forms a boundary (ridge) between the side surface 63*c* and curved surface 120*a* is formed in the shape of R. The slide member 120 is provided as a taper in the section where the curved surface 120*s* is provided. Further, the slide member 120 is installed such that the curved surface 120*a* becomes the end (tip) side of the downstream side of the bottle movement direction in the supply means 60.

Even when using such a slide member 120 instead of the slide member 63, similar to the front end surface 63*b* formed with the inclination, it is in the form of a taper in the section where the curved surface 120*b* has been provided, and is inclined in the downward direction. Therefore, even if the vial B gets on the sliding surface 63*a* such that the side (top side) having the flange 110 is oriented towards the tip of the slide member 120, the recess 116 formed in the boundary between the flange 110 and fixed part 112, or the rib 114 does not get stuck at the tip of the slide member 120. In addition to the curved surface 120*a* curved in the downward direction, the ridge 120*b* is formed in the shape of R. Therefore, if the vial B sliding on the sliding surface 63*a* of the slide member 120 reaches the section where the curved surface 120*a* is provided, the posture of the vial B, due to the balance of its own weight, smoothly changes over to an upright. Accordingly, like the slide member 120 described above, even by providing the curved surface 120*a* at the tip, or providing the ridge 120*b* in the form of R, it is possible to smoothly deliver the vial B, making it in an upright posture.

To deliver the vial B smoothly with its posture changing but without getting stuck, even though it is desirable that the ridge 120*b* be in a smoothly-sloping form of R shape, it may be chamfered. In such a configuration, compared to the case wherein the ridge 120*b* is sharp so as to form a ridge line, the vial B can be delivered with a smooth posture change without getting stuck.

In the medicament filling machine of the above embodiment, although popping out of the vial B is prevented by the stopper 67 provided in the supply means 60, the configuration or mechanism of preventing popping out of the vial B is not limited to the stopper 67. Specifically, in the medicament filling machine 10, it is also possible to use the label printer 72 (labeling pasting means), which is provided in a location in downstream movement direction of the vial B and distant from the location of vial B discharge, for preventing the pop out of the vial B.

More specifically, as shown in FIG. 6, when the label printer pastes a label on the outer circumference of the vial B, the rollers 72*a* may be provided to abut the outer surface of the vial B (periphery abutting means), and may move to the discharge location of the vial B in the supply means 60 (hereafter, this state is also referred as 'pop out prevention state'). Therefore, in the medicament filling machine 10, during the period from when the vial B is discharged from the loading means 54 to the supply means 60 and to when it is charged in a upright state from the supply means 60, if the rollers 72*a* of the label printer 72 is set to a pop out prevention state, the popping out of the vial B can be prevented more reliably. Moreover, to reliably prevent the popping out of the vial B from the supply means 60, although it is preferable to set the rollers 72*a* in the pop out prevention state for the entire period starting from the time of discharging of the vial B from the loading means 54 to the supply means 60 to the time of being discharged in a upright state from the supply means 60, it is not necessary to set up the pop out prevention state in all the time, and the rollers 72*a* may be set to be in the pop out prevention state only part of the above duration.

In the aforementioned medicament filling machine 10, the vials B are randomly stored in the stocker 42, the vial B is moved towards the extraction means 50 by actuating the conveyor 48 provided at the bottom of the stocker 42, and by the extraction means 50 the vial B is discharged from the stocker 42. If a sensor (not shown) provided in the stocker 42 detects that the excess number of vials B accommodated in the stocker 42, it is possible to operate the conveyor 48 in a direction reverse to the above described direction, and avoid piling up of the vials B that are present inside the stocker 42.

In case the conveyor 48 is operated in a reverse direction, it is possible that the empty vials B stagnating near the wall adjacent to the upstream of discharge direction with respect to the conveyor 48 are aggregated by mutual engagement and form a longer aggregation in the axial direction (height direction) of the vial B. Such aggregation, wherein several vials are engaged with one another, cannot be used for filling of medicine even it is dispatched from the stocker 42 to the downstream process. In addition, it can cause an operation failure of the medicament filling machine 10 such as the aggregation gets stuck in various locations downstream of the stocker 42. Therefore, if the conveyor 48 is operated in the reverse direction, it is preferable to provide some measure so that the stagnation of the vials B between the conveyor 48 and the stocker 42 becomes difficult. Specifically, for example, it is possible to provide the bottle sliding wall 130 made of a material such as polyacetal resin (POM) for easy sliding of the vial B between the conveyor 48 and stocker 42 as shown in FIG. 21.

Figure 21:
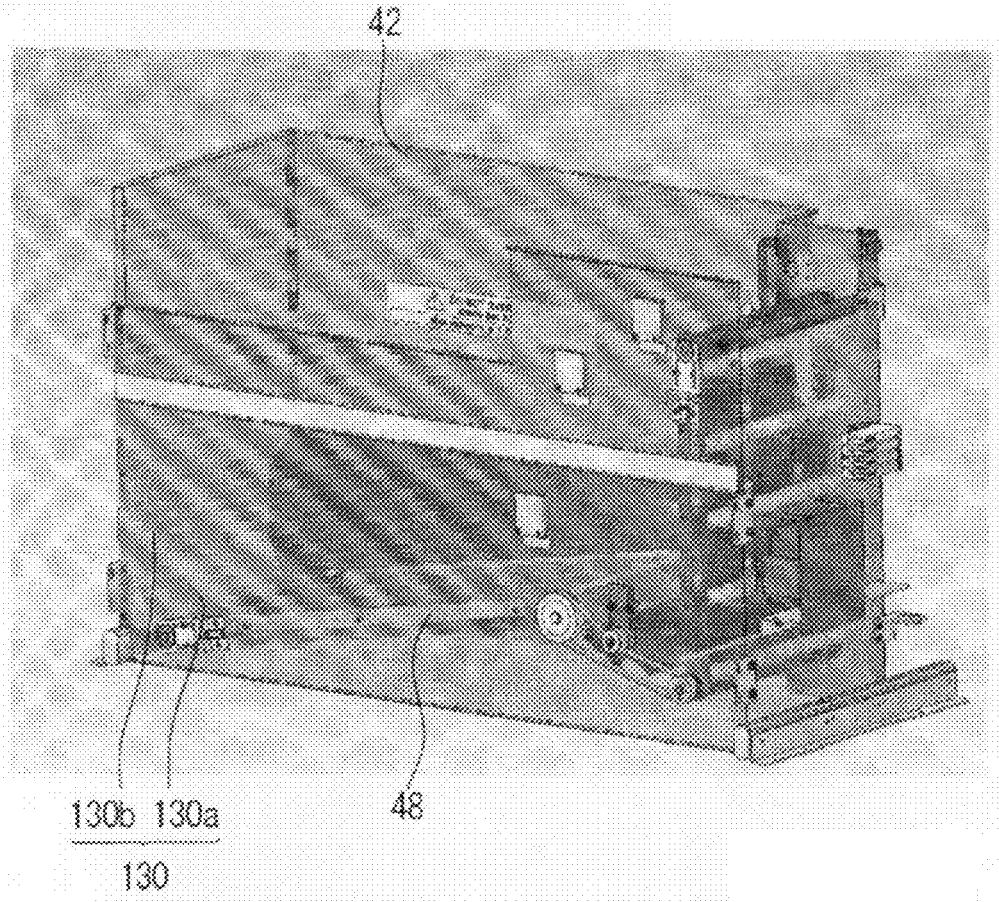
FIG. 21 is a perspective view of the stocker and bottle sliding wall.

The bottle sliding wall 130 shown in FIG. 21 is comprised of an ascending slope section 130*a* and a vertical section 130*b*. The ascending slope section 130*a* is away from the conveyor 48, and inclined such that it orients upwards as it approaches the inner wall of the stocker 42. Therefore, when the conveyor 48 is operated in the reverse direction, the vials B smoothly move along the ascending slope section 130*a*, and rarely stagnate.

Further, the vertical section 130*b* is continuous with the ascending slope section 130*a*, and is nearly vertical with an inclination steeper than that of the ascending slope section 130*a*. Therefore, there is no chance that the vial B becomes stuck in the upper end portion of the ascending slope section 130*a*. The vial B slides smoothly along the slide wall 130, and the vials B are prevented from being aggregated due to the mutual engagement of the vials B more reliably. More specifically, if the vertical section 130*b* were not provided in the bottle sliding wall 130, the upper end section of the ascending slope section 130*a* would become continuous with the inner wall of the stocker 42. Since the sliding of the vial B in the inner wall of the stocker 42 is inferior to that of the ascending slope section 130, the vial B which comes climbing along the ascending slope section 130*a* can easily stagnate in the upper end of the ascending slope section 130*a*. If the vial B can easily stagnate, by operating the conveyor 48 in the reverse direction, another vial B that comes climbing from bottom along the ascending slope 130*a* can engage.

However, as described above, if a nearly vertical section 130*b* that is continuous with the top end of the ascending slope section 130*a* and having inclination steeper than the ascending slope section 130*a* is provided, the vial B that moves up to the top end portion of the ascending slope section 130*a* due to the reverse operation of the conveyor 48 does not stagnate, and smoothly slides further along the vertical section 130*b*. Since the vertical section 130*b* has a vertical or near-vertical inclination, the vial B that has arrived at the vertical section 130*b* eventually freely falls, and does not stagnate. Therefore, if the vertical section 130*b* is provided, the vial B smoothly slides without stagnating when the conveyor 48 is operated in the reverse direction, and the possibility that the vials B mutually engages decreases significantly.

By providing the sliding wall 130, although aggregation of the vials B through mutual engagement inside the stocker 42 can be prevented, even in the case an aggregate of the vials B is retrieved from the stocker 42, if this is suitably detected, feeding of the aggregate to the loading means 54 and the supply means 60 can be prevented. Thereupon, if such a scenario is assumed, by checking the presence of the vial B with the bottle detection sensor 101 (bottle detection means) provided at the discharge location of vial B in the transport means 52, it is possible to judge the existence of a cluster of vials B based on the detection state of this bottle detection sensor 101.

More specifically, the aggregate of the vials B formed by engagement of plural vials B (hereafter, also referred as 'aggregated material') is longer in the longitudinal direction (vertical direction) of the vial B. Therefore, after checking the existence of the vial B in the discharge location of the transfer means 52 by the bottle detection sensor 101, if the transfer means 52 is operated only by a distance X that is just sufficient to discharge a single vial B from the discharge location, but the presence of the vial B is still detected by the bottle detection sensor 101, the probability that the vial B being discharged is an aggregated material is high. Therefore, after the vial B is detected by the bottle sensor 101 and the transfer means 52 operates by a movement distance X, if the vial B is still detected (hereafter, also referred as 'first criterion'), it may be determined that the vial B is fed as an aggregated material.

The movement distance X described above may be sufficient if a single vial B is discharged from the discharge location, and it is not necessary to make it equal to or longer than the length of a single vial B. That is, even if the movement distance X is shorter than the length of a single vial B, it is assumed that when the single vial B protrudes from the discharge location to the outside of the transfer means 52, the vial B freely falls due to its own weight balance. However, when the vial B is in the form of the aggregate material, the weight balance is different from that of the single vial B. Therefore, even if the aggregated material projects from the end of the transfer means as where an independent vial B freely falls, it does not freely fall and remains in the transfer means 53, and is detected by the bottle detection sensor 101. Therefore, as long as the movement distance X is a distance such that an individual vial B is dispatched from the discharge location, it can be shorter than the length of the vial B.

Further, when checking if the vial B is an aggregated material based on the detection result by the bottle detection sensor 101, in addition to the first criterion described above, other criteria can also be added. Specifically, after satisfying the first criterion, it may be determined that a discharge failure has occurred due to the aggregated material when the transfer means 52 is operated by a predetermined amount in a direction opposite to the discharge direction of the vial B, and the presence of the vial B is still detected by the bottle detection sensor 101 (hereafter, also referred as 'second criterion'). By providing the second criterion, when the vials B are queuing in the transfer means 52 as an individual state without aggregating, wrong judgment that an aggregated material is formed can be prevented.

More specifically, when the first criterion is satisfied, normally, plural vials B are thought to have formed an aggregated material. However, although being a rare case, when the vial B arriving at the discharge location of the transfer means 52 and another vial B in a location adjacent to the downstream side of this vial B are queuing up without a gap, the above described first criterion may be satisfied even though there is no aggregated material. That is, among the vials B that are queuing in a non-engaged state, if one vial B present at the most downstream reaches the discharge location of the transfer means 52, and is further moved only by the movement distance X, only this vial B is successfully delivered from the transfer means 52 to the loading means 54. During this, another vial B located adjacent to the upstream of the discharged vial B also moves towards the discharge side by the movement distance X, and reaches the discharge location of the transfer means 52. Therefore, when the vials B on the transfer means 52 are queuing up without a gap, regardless the fact that the vials B are not mutually engaged, the first criterion may be satisfied because the presence of the vial B is still detected by the bottle detection sensor 101 even after moving by the movement distance X.

In the case plural vials B are an aggregated material, it protrudes out of the discharge location of the transfer means 52, but does not fall. Therefore, after satisfying the first criterion, if the transfer means 52 is operated so as to move only by a predetermined amount in a direction opposite to the discharge direction, and if the aggregated material exists, the vial B at the top is pulled back, and detected by the bottle detection sensor 101. On the other hand, if the first criterion is satisfied regardless of the absence of the aggregated material, the vial B, which is located at top (discharge side) and which caused the satisfaction of the first criterion, is already discharged. Therefore, even if the transfer means 52 is operated in the reverse direction after satisfying the first criterion, the vial B that existed at top cannot be pulled back to the transfer means 52. Further, at the time when the first criterion is satisfied, although the vial B that was in a location adjacent to upstream of the discharged vial B is detected by the bottle detection sensor 101, by operating the transfer means 52 in the reverse direction, it will be pulled back to a location where it is not detected by the bottle detection sensor 101. Therefore, in the case that there is no aggregated material, if the transfer means 52 is operated in the reverse direction after satisfying the first criterion, there will be no detection by the bottle detection sensor 101. Therefore, if the second criterion is provided, the existence of the aggregated material is more accurately determined.

The above described second criterion is not an essential criterion for determining the existence of the aggregated material, and it may be omitted. That is, the second criterion takes into consideration of an extremely rare situation wherein two or more vials B queues up on the transfer means 52 almost without any gaps, and in the case it is not necessary to consider such a situation, the second criterion need not be provided. If the second criterion is not provided, there is a possibility that the vials B may be judged to be in an engaged state although the vials B are in a non-engaged state. However, such configuration can still by reliably detect the vial B forming an aggregated material, and failures due to feeding an aggregated material of the vial B to the subsequent processes can be still prevented.

The second criterion described above is an example of judging the existence of the aggregated object, and another criterion may be used instead of the second criterion, or other criteria may be added to the second criterion. Specifically, when plural vial B exist in a non-engaged state on the transfer means 52, at the moment the first criterion is satisfied, the vial B existing at top (discharge side) falls from the transfer means 52 towards the loading means 54 and is discharged. On the other hand, in the case plural vials B aggregate by mutual engagement, the vial B does not fall from the transfer means 52, and is not loaded to the loading means 54. Due to this, the vial B that has entered the loading means 54 can be detected by a sensor provided separately (not shown), and after satisfying the first criterion, a non-detection of the vial B in the loading means 54 may be made as a second or third criterion. By providing such a criterion, the presence or absence of vial B that has become aggregated by engaging can be reliably detected, and failures caused by supplying the aggregated vials B are prevented.

EXPLANATION OF NUMBERS

10 Medicament filling machine
42 Stocker (bottle storage unit)
48 Conveyor
52 Transfer means
54 Loading means (dispatch mechanism unit)
54*c* Loading strip
54*h* Intrusion-restraining arm (bottle-restraining means)
56 Regulation means
56*a* Flap (Plate body)
60 Supply means (upright-discharge unit)
61 Slide section
63, 120 Slide member
63*a* Sliding surface
63*b* Front end surface (downward slope section)
63*c* Side surface
67 Stopper
72 Label printer (Label pasting means)
72*a* Roller (outer periphery abutting means)
101 Bottle detecting sensor (bottle detection means)
120*a* Curved surface (downward slope section)
120*b* Ridge
130 Bottle sliding wall
130*a* Ascending slope section
130*b* Vertical section

The invention claimed is:

1. A medicament filling machine, comprising:
a bottle storage unit that stores a vial;
a dispatch mechanism unit that receives and dispatches the vial extracted from the bottle storage unit by an extraction unit, said dispatch mechanism unit comprises a loading strip which is formed integrally as a single-piece bent into an L-shape form;
an upright-discharge unit that receives the vial dispatched from the dispatch mechanism unit and that discharges the vial in an upright posture; and
a regulation member provided between the dispatch mechanism unit and the upright-discharge unit,
wherein the dispatch mechanism unit dispatches the vial by moving towards the upright-discharge unit.

2. The medicament filling machine of claim 1, wherein the regulation member restricts a movement of the vial from the dispatch mechanism unit to the upright-discharge unit and/or restricts a posture of the vial in the dispatch mechanism unit.

3. The medicament filling machine of claim 1, further comprising a stopper for restricting a movement of the vial in a downstream direction, the stopper being provided at a location downstream of the regulation member.

4. The medicament filling machine of claim 1, further comprising a slide unit at a location downstream of the regulation member, wherein the vial dispatched from the dispatch mechanism unit slides on the slide unit.

5. The medicament filling machine of claim 4, wherein a pair of sliding surfaces is provided on the slide unit, and the vial slides on the pair of sliding surfaces; and
wherein the pair of sliding surfaces is inclined downward as going in a downstream direction of the vial movement.

6. The medicament filling machine of claim 4, wherein a pair of sliding surfaces is provided on the slide unit, and the vial slides on the pair of sliding surfaces; and
wherein a gap between the pair of sliding surfaces gradually increases as going in a downstream direction of the vial movement.

7. The medicament filling machine of claim 4, wherein a pair of sliding surfaces is provided on the slide unit, and the vial slides on the pair of sliding surfaces; and
wherein a gap between the pair of sliding surfaces gradually decreases as going in a downward direction.

8. The medicament filling machine of claim 4, wherein a pair of sliding surfaces is provided on the slide unit, and the vial slides on the pair of sliding surfaces; and
wherein the pair of sliding surfaces comprises a downward slope section formed of a descending slope in a downstream direction of the vial movement; and
wherein the downward slope section comprises a curved surface that curves downwards.

9. The medicament filling machine of claim 8, wherein the slide unit comprises a side surface that is located below the sliding surface and that is continuous to the sliding surface; and
wherein a boundary between the downward slope section and the side surface is curved or chamfered.

10. The medicament filling machine of claim 1, further comprising a labeling device for pasting a label on the vial, the labeling device being located in a downstream direction of the vial movement and placed distant from a discharge position of the vial in the upright-discharge unit;
wherein the labeling device comprises an outer periphery abutting member that contacts with an outer periphery of the vial; and
wherein the outer periphery abutting member prevents the vial from coming off during at least a part of period during which the vial is dispatched from the dispatch mechanism unit to the upright-discharge unit and the vial is dispatched from the upright-discharge unit in the upright posture.

11. The medicament filling machine of claim 1, wherein the bottle storage unit comprises:
a stocker that stores the vials, a conveyor that is provided at a bottom portion of the stocker and that conveys the vial, and a bottle-sliding wall on which the vial slides, the bottle-sliding wall being provided at a location adjacent to the conveyor and upstream of a conveying direction of the vial by the conveyor.

12. The medicament filling machine of claim 1, further comprising:

a transfer unit that is provided between the dispatch mechanism unit and the bottle storage unit and that moves and dispatches the vial, dispatched from the bottle storage unit, to the dispatch mechanism unit; and a bottle detection sensor that detects an existence of the vial at a location where the vial is discharged from the transfer unit; and wherein the medicament filling machine determines if a discharge failure of the vial has occurred based on a condition in which the bottle detection sensor detects the existence of the vial after the bottle detection sensor detects the existence of the vial at the location where the vial is discharged and after the transfer unit moves the vial by a distance sufficient to discharge the vial from the transfer unit.

13. The medicament filling machine of claim 1, wherein the loading strip comprises a bottom plate section, a rear plate section, and an intrusion restraining piece which extends from the edge of said bottom plate section.

14. The medicament filling machine of claim 1, wherein the dispatch mechanism unit further comprises a pair of guides which are disposed facing each other by providing a gap larger than a diameter of the vial.

15. The medicament filling machine of claim 14, wherein the loading strip is provided within the gap which is formed between the pair of guides.

16. A medicament filling machine, comprising:

an extraction unit that extracts a vial from a bottle storage unit;

a dispatch mechanism unit that receives and dispatches the vial extracted from the bottle storage unit by the extraction unit, said dispatch mechanism unit comprises a loading strip which is formed integrally as a single-piece bent into an L-shape form;

an upright-discharge unit that receives the empty vial dispatched from the dispatch mechanism unit and that discharges the empty vial in an upright posture; and a regulation member provided between the dispatch mechanism unit and the upright-discharge unit;

wherein when the dispatch mechanism unit receives the vial, the regulation member restricts a movement of the vial from the dispatch mechanism unit to the upright-discharge unit; and wherein when the dispatch mechanism unit dispatches the vial to the upright-discharge unit, by moving towards said upright-discharge unit, the restriction of the movement of the vial incurred by the regulation member is released.

17. The medicament filling machine of claim 16, wherein the regulation member comprises a plate rotatable around a shaft;

wherein when the dispatch mechanism unit receives the vial, the regulation member partitions a space between the dispatch mechanism unit and the upright-delivery unit; and wherein when the dispatch mechanism unit dispatches the vial, the regulation member is pressed and rotated by the dispatch mechanism unit and/or the vial in the dispatch mechanism unit, and lets the vial move from the dispatch mechanism unit to the upright-discharge unit.

18. The medicament filling machine of claim 16, wherein the dispatch mechanism unit dispatches the vial by tumbling towards the upright-discharge unit.

19. The medicament filling machine of claim 16, wherein the loading strip comprises a bottom plate section, a rear plate section, and an intrusion restraining piece which extends from the edge of said bottom plate section.

20. The medicament filling machine of claim 16, wherein the dispatch mechanism unit further comprises a pair of guides which are disposed facing each other by providing a gap larger than a diameter of the vial, and wherein the loading strip is provided within the gap which is formed between the pair of guides.

* * * * *